US012181174B2

(12) United States Patent
Kim et al.

(10) Patent No.: US 12,181,174 B2
(45) Date of Patent: Dec. 31, 2024

(54) CEILING TYPE AIR CONDITIONER

(71) Applicant: SAMSUNG ELECTRONICS CO., LTD., Suwon-si (KR)

(72) Inventors: Munsub Kim, Suwon-si (KR); Jaewoo Choi, Suwon-si (KR); Hyunwuk Kang, Suwon-si (KR); Hyeongjoon Seo, Suwon-si (KR); Churju Lee, Suwon-si (KR); Duhan Jung, Suwon-si (KR); Jun Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 261 days.

(21) Appl. No.: 17/739,561

(22) Filed: May 9, 2022

(65) Prior Publication Data

US 2022/0260276 A1 Aug. 18, 2022

Related U.S. Application Data

(63) Continuation of application No. PCT/KR2021/010340, filed on Aug. 5, 2021.

(30) Foreign Application Priority Data

Aug. 11, 2020 (KR) ..... 10-2020-0100337
Aug. 4, 2021 (KR) ..... 10-2021-0102496

(51) Int. Cl.

| | |
|---|---|
| ***F24F 13/14*** | (2006.01) |
| ***F24F 1/0011*** | (2019.01) |
| ***F24F 1/0047*** | (2019.01) |

(52) U.S. Cl.
CPC ..... *F24F 13/1413* (2013.01); *F24F 1/0011* (2013.01); *F24F 1/0047* (2019.02); *F24F 13/1486* (2013.01); *F24F 2221/14* (2013.01)

(58) Field of Classification Search
CPC ..... F24F 12/1413; F24F 2007/001; F24F 1/0047; F24F 1/0011; F24F 13/1486; F24F 2221/14; F24F 13/1413
See application file for complete search history.

(56) References Cited

FOREIGN PATENT DOCUMENTS

| | | |
|---|---|---|
| CN | 106949615 | 7/2017 |
| EP | 3 569 940 A1 | 11/2019 |
| EP | 3 671 053 A1 | 6/2020 |
| JP | 2000-9342 | 1/2000 |

(Continued)

OTHER PUBLICATIONS

English language translation of KR102454762 related to KR20190053594, to Young et al. Translated Mar. 2024 (Year: 2019).*

(Continued)

*Primary Examiner* — Cassey D Bauer
(74) *Attorney, Agent, or Firm* — STAAS & HALSEY LLP

(57) ABSTRACT

A ceiling type air conditioner includes a housing having an inlet and an outlet, a heat exchanger provided inside the housing to exchange heat with air suctioned through the inlet, a blower fan configured to cause the air having heat exchanged with the heat exchanger to flow such that the air having heat exchanged is discharged through the outlet, and a blade unit configured to guide the air discharged to the outlet. The blade unit includes a main blade, a sub-blade, and a guide link provided to guide a movement of the sub-blade.

15 Claims, 29 Drawing Sheets

(56) References Cited

FOREIGN PATENT DOCUMENTS

| | | |
|---|---|---|
| JP | 2009-19831 | 1/2009 |
| JP | 4278841 | 6/2009 |
| JP | 2014-31894 | 2/2014 |
| KR | 10-2009-0008629 | 1/2009 |
| KR | 10-1172683 | 8/2012 |
| KR | 10-2014-0101284 | 8/2014 |
| KR | 10-1499985 | 3/2015 |
| KR | 10-2019-0027335 | 3/2019 |
| KR | 10-2019-0042201 | 4/2019 |
| KR | 10-2019-0052387 | 5/2019 |
| KR | 10-2019-0053594 | 5/2019 |

OTHER PUBLICATIONS

English language translation of KR 10-2019-0042201 to Kang et al. Translated Mar. 2024 (Year: 2019).*
International Search Report and Written Opinion dated Dec. 7, 2021 from International Application No. PCT/KR2021/010340.
Extended European Search Report dated Nov. 3, 2023 in European Patent Application No. 21856135.5.

* cited by examiner

CEILING TYPE AIR CONDITIONER

CROSS-REFERENCE TO RELATED APPLICATION(S)

This application is a continuation application, under 35 U.S.C. § 111(a), of International Application No. PCT/KR2021/010340, filed Aug. 5, 2021, which is based on and claims priority under 35 U.S.C. § 119 to Korean Patent Application No. 10-2020-0100337, filed on Aug. 11, 2020 and Korean Patent Application No. 10-2021-0102496 filed on Aug. 4, 2021, in the Korean Intellectual Property Office, the disclosure of which are incorporated by reference herein in their entireties.

BACKGROUND

1. Field

The present disclosure relates to a ceiling type air conditioner, and more specifically, to a ceiling type air conditioner including a blade structure for controlling a direction of an airflow discharged from an indoor unit.

2. Description of Related Art

In general, a ceiling type air conditioner refers to an apparatus that adjusts temperature, humidity, airflow, etc. to be suitable for human activity using a refrigeration cycle while removing dust, etc. in the air.

The ceiling type air conditioner includes an outdoor unit and an indoor unit. The outdoor unit includes a compressor, an outdoor heat exchanger, an expansion device, and the like, and the indoor unit includes an indoor heat exchanger, a blower fan, and the like, and the expansion device may be provided in the indoor unit.

Meanwhile, the comfort felt by occupants may be greatly different depending on the direction of the airflow discharged from the indoor unit of the ceiling type air conditioner. For example, air discharged during a cooling operation has a characteristic of falling downward, and occupants directly exposed to the air may feel growing discomfort. Therefore, it is important to gradually control the temperature of the indoor space by transmitting the air far away in the horizontal direction to prevent the discharged air from falling directly downward. On the other hand, the air discharged during a heating operation has a characteristic of rising upward, which may lower the sensible temperature in a space below the air conditioner in which occupants are located, and thus it is important to transmit the discharged air far away in a downward direction.

SUMMARY

Additional aspects will be set forth in part in the description which follows and, in part, will be apparent from the description, or may be learned by practice of the presented embodiments.

According to an aspect of the disclosure, there is provided a ceiling type air conditioner including: an inlet for suctioning air; a heat exchanger provided to have the suctioned air heat-exchanged with a refrigerant; a blower fan configured to transfer the heat-exchanged air to an outlet; and a blade configured to guide movement of the air discharged to the outlet.

The blade may include: a main blade coupled to a rotating shaft to be rotatable with respect to a first rotation center and arranged at an end portion of the blade; a hinge rotatably coupled to a guide member of the main blade; and a connecting rod having one end portion provided to rotate with respect to a second rotation center and the other end coupled to the hinge to cause the hinge to be rotated according to the rotation of the main blade; and a sub-blade rotatably coupled to the hinge and rotated by being in contact with the guide member of the main blade according to rotation of the main blade.

The hinge may include a first rotation joint portion coupled to the guide member, a second rotation joint portion coupled to the connecting rod, and a third rotation joint portion coupled to the sub-blade.

The first rotational joint portion may include a through hole through which a joint of the guide member passes, the second rotational joint portion may include a joint passing through a through hole provided at the other end portion of the connecting rod, and the third rotational joint portion may include a through hole through which a joint of the sub-blade passes.

The hinge may be rotated on the first rotation joint portion.

The distance between the second rotation center and the second rotation joint portion may be longer than the distance between the first rotation center and the first rotation joint portion.

The first rotation joint portion may be provided at a position lower than a position of the second rotation joint portion.

The distance between the second rotation center and the second rotation joint portion may be shorter than the distance between the first rotation center and the first rotation joint portion.

The first rotation joint portion may be provided at a position higher than a position of the second rotation joint portion.

The guide member may include a contact member configured to be in contact with the sub-blade to guide rotation of the sub-blade.

The sub-blade may include a contact portion in contact with the guide member.

The contact member may include a first gear having a toothed shape, and the contact portion of the sub-blade may include a second gear provided to be engaged with the first gear.

The contact member may include a contact surface having an arc shape, and the contact portion of the sub-blade may include a downward inclined surface.

The main blade may further include a coupling member rotatably coupled to the rotating shaft and a body member coupled to the coupling member, and the sub-blade may further include a panel portion extending from the contact portion.

Each of the body member and the panel portion may include a plurality of holes through which air may pass.

The rotating shaft may be driven by a stepping motor.

According to another aspect of the disclosure, there is provided a ceiling type air conditioner provided suspended from or installed into a ceiling, the ceiling type air conditioner including: a housing including an inlet and an outlet; a heat exchanger provided inside the housing, a blower fan configured to suction air into the housing through the inlet and discharge air out of the housing through the outlet; a main blade configured to rotate on a rotating shaft to open the outlet to discharge air; and a sub-blade coupled to face an inner side of the main blade and configured to rotate in a direction way from the inner side of the main blade according to rotation of the main blade, to guide the air such that the air is discharged in a direction away from the outlet.

The main blade may be rotated at a predetermined angle with respect to the outlet so that the air is discharged at a predetermined air volume.

During a heating operation, the main blade may be rotated to a lower side of the outlet, and the sub-blade may be rotated to face in the same direction as the main blade.

During a cooling operation, the sub-blade may be rotated to be directed toward the front of the outlet.

According to another aspect of the disclosure, there is provided a ceiling type air conditioner including: a housing having an inlet and an outlet; a heat exchanger provided inside the housing to exchange heat with air suctioned through the inlet; a blower fan configured to cause the air having heat exchanged with the heat exchanger to flow such that the air having heat exchanged is discharged to the outlet; and a blade unit configured to guide the air discharged to the outlet, wherein the blade unit includes: a main blade provided to be rotatable with respect to a first rotation center to open and close the outlet; a sub-blade having one side become closer to the first rotation center and an other side become distant from the first rotation center according to the rotation of the main blade, to increase a reachable distance of the air discharged to the outlet; and a guide link configured to rotate with respect to a second rotation center in association with the rotation of the main blade, and connected to the one side of the sub-blade to guide a movement of the sub-blade.

The sub-blade may include: a first joint portion rotatably coupled to the main blade; and a second joint portion rotatably coupled to the guide link.

The guide link may include: a first end portion provided to form the second rotation center; and a second end portion rotatably coupled to the second joint portion of the sub-blade.

The sub-blade may be provided to adjust a discharge direction of the air discharged to the outlet.

The main blade may be rotatable between a first position and a second position, and when the main blade is in the first position, the first joint portion of the sub-blade may be located above the second joint portion, and when the main blade is in the second position, the first joint portion of the sub-blade may be located below the second joint portion.

During a heating operation, the main blade may be provided to be located in the second position.

The sub-blade may further include a first surface that faces the main blade when the main blade is in the first position, and a second surface opposite to the first surface.

When the main blade is in the second position, the first surface of the sub-blade may be provided to guide the air discharged to the outlet, and a portion of the second surface of the sub-blade may be provided to face the main blade.

As the main blade and the sub-blade rotate, an angle between the main blade and the sub-blade may be provided to increase.

A distance between the second rotation center and the second joint portion may be provided to be shorter than a distance between the first rotation center and the first joint portion.

The blade unit may further include a motor configured to provide a rotation force, and the main blade may be provided to be coupled to a rotating shaft of the motor.

The blade unit may include: a motor configured to provide a rotation force; a first driving link provided to be coupled to a rotating shaft of the motor; and a second driving link having one end portion coupled to the first driving link and an other end portion coupled to the main blade, the second driving link configured to guide a movement of the main blade such that the main blade rotates with respect to the first rotation center.

The main blade may include a main blade body and a plurality of first discharge holes passing through the main blade body; the sub-blade may include a sub-blade body and a plurality of second discharge holes passing through the sub-blade body; and the blade unit may be provided to discharge air through the plurality of first discharge holes and the plurality of second discharge holes The sub-blade may rotate in a same direction as the main blade.

The blade unit may be provided to be operable in a first mode for discharging air through a plurality of first discharge holes formed in the main blade and a plurality of second discharge holes formed in the sub-blade, a second mode for allowing air discharged to the outlet to be guided in a downward direction, and a third mode for allowing air discharged to the outlet to be guided in a horizontal direction.

BRIEF DESCRIPTION OF THE DRAWINGS

The above and other aspects, features, advantages of certain embodiments of the present disclosure will be more apparent form the following description taken in conjunction with the accompanying drawings, in which.

DETAILED DESCRIPTION

Figure 1:
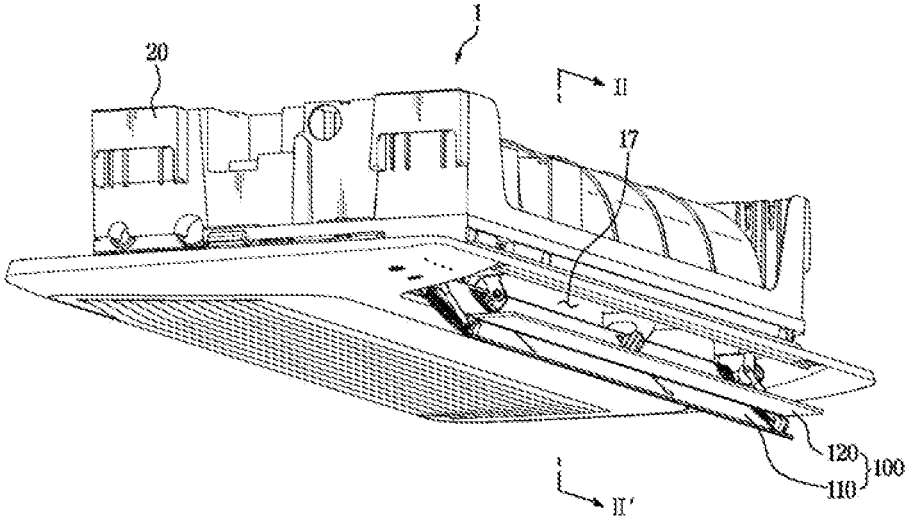
FIG. 1 is a perspective view illustrating a ceiling type air conditioner according to an embodiment of the present disclosure.

Embodiments described in the specification and configurations shown in the accompanying drawings are merely exemplary examples of the present disclosure, and various modifications may replace the embodiments and the drawings of the present disclosure at the time of filing of the present application.

Further, identical symbols or numbers in the drawings of the present disclosure denote components or elements configured to perform substantially identical functions.

Further, terms used herein are only for the purpose of describing particular embodiments and are not intended to limit to the present disclosure. The singular form is intended to include the plural form as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," etc. may be used herein to describe various elements, the elements are not limited by the terms, and the terms are only used to distinguish one element from another. For example, a first element could be termed a second element, and similarly, a second element could be termed a first element without departing from the scope of the present disclosure. The term "and/or" includes combinations of one or all of a plurality of associated listed items.

Meanwhile, the terms "front and rear directions", "front side", "rear side", "upper portion", "lower portion", "upper side", "lower side", etc. used in the following description are defined based on the drawings, and by the terms may not restrict the shape and position of each component. For example, a direction of air discharged from a discharge port (an outlet) 17 to be described below may be defined as a front, and a direction opposite to the front may be defined as a rear. Specifically, a direction toward which an inlet 15 faces may be referred to as a rear, and a direction opposite to the rear may be referred to as a front.

One aspect of the disclosure provides a ceiling type air conditioner that allows air discharged from an indoor unit to reach a long distance.

Another aspect of the disclosure provides an air conditioner capable of controlling the direction of an airflow at various angles without reduction of the air volume.

According to an aspect of the disclosure, there is provided a ceiling type air conditioner including: an inlet for suctioning air; a heat exchanger provided to have the suctioned air heat-exchanged with a refrigerant; a blower fan configured to transfer the heat-exchanged air to an outlet; and a blade configured to guide movement of the air discharged to the outlet.

According to an aspect of the disclosure, comfort of occupants can be improved by preventing the cold airflow from falling downward during a cooling operation using a sub-blade.

The sensible temperature of occupants during a heating operation can be increased by allowing air to reach a long distance through a sub-blade.

A windless flow may be implemented with a blade-closed state by applying a porous structure to the surface of a main blade and a sub-blade.

Hereinafter, an embodiment will be described in detail with reference to the accompanying drawings.

Figure 2:
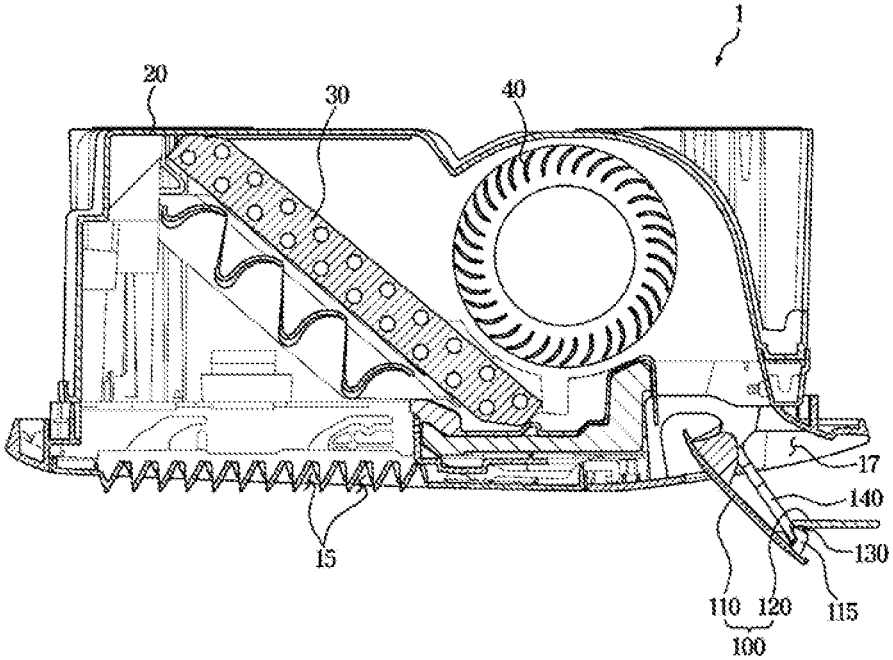
FIG. 2 is a cross-sectional view taken along II-II' of the ceiling type air conditioner of FIG. 1.

FIG. 1 is a perspective view illustrating a ceiling type air conditioner according to an embodiment of the present disclosure, and FIG. 2 is a cross-sectional view taken along II-II' of the ceiling type air conditioner of FIG. 1;

Referring to FIGS. 1 and 2, an air conditioner 1 includes a housing 20 having an inlet 15 and a discharge port (which may also be referred to as an 'outlet') 17, a heat exchanger 30 for exchanging heat with air flowing into the housing 20, and a blower fan 40 for circulating air to the inside or outside of the housing 20.

The air conditioner 1 illustrated in the present disclosure is a ceiling type air conditioner 1 suspended from the ceiling or embedded in the ceiling, but the disclosure is not limited thereto. For example, the air conditioner 1 according to the present disclosure may be a wall-mounted air conditioner or a stand-type air conditioner.

The housing 20 may be provided to form the overall appearance of the air conditioner 1.

The blower fan 40 may be arranged inside the housing 20. The blower fan 40 may be a cross-flow fan having the same longitudinal direction as the longitudinal direction of the housing 20. The blower fan 40 may blow air such that air is suctioned from the inlet 15 and the air is discharged to the outlet.

The heat exchanger 30 may be arranged adjacent to the blower fan 40, preferably between the inlet 15 and the blower fan 40. With such a configuration, external air may be suctioned through the inlet 15 and heat-exchange with the heat exchanger 30, after which the heat-exchanged air may be discharged to the outside through the outlet 17.

The air conditioner 1 may include a blade 100 provided to open and close the outlet 17. The blade 100 may be referred to as a 'blade unit' or a 'blade assembly'.

The blade 100 may be rotatably provided on the housing 20. The blade 100 may be provided to be rotatable with respect to a rotating shaft of the blade 100.

The rotating shaft of the blade 100 may be located on an inner surface of the housing 20.

Figure 11:
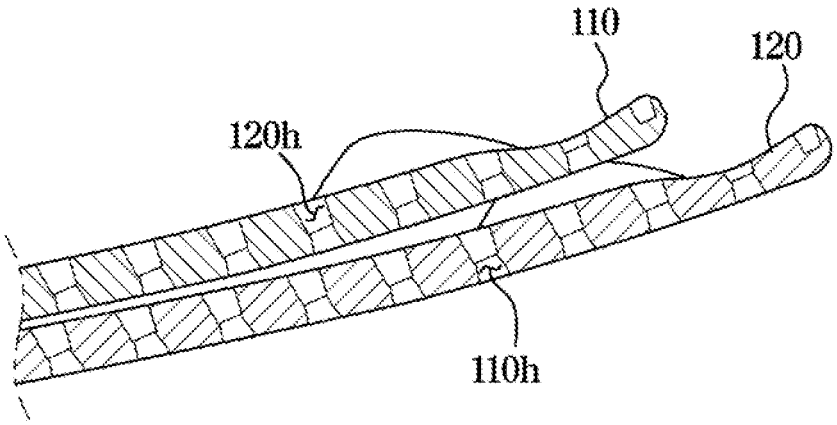
FIG. 11 is a schematic view illustrating the blade when an outlet is closed in the ceiling type air conditioner of FIG. 1.

The blade 100 may include a main blade 110 for guiding a movement of air, and a sub-blade 120 coupled to the main blade 110 to guide the air further away. The main blade 110 may be provided with a size corresponding to a size of the outlet 17. Accordingly, the main blade 110 may close the outlet 17. In this case, air may be discharged to the outside of the housing 20 through a plurality of holes 110*h* of the main blade 110 (see FIG. 11).

The sub-blade 120 may be provided to be smaller than the main blade 110. The sub-blade 120 may be arranged to face an inner surface of the main blade 110 when the outlet 17 is closed by the main blade 110. In this case, air may pass through a plurality of holes 120*h* of the sub-blade 120 and then through the plurality of holes 110*h* of the main blade 110 to flow outside (see FIG. 11). That is, in a state in which the main blade 110 closes the outlet 17, air may be discharged out of the housing 20 through the plurality of holes 110*h* of the main blade 110 and the plurality of holes 120*h* of the sub-blade 120. In other words, the air conditioner may perform a windless operation in which air is discharged to the outside by implementing a windless airflow. Here, the windless operation may refer to a low air volume operation in which air is discharged at a predetermined speed or less while preventing air from being directly blown to the user.

On the other hand, when the main blade 110 opens the outlet 17, the sub-blade 120 may be arranged to be directed forward of the outlet 17 as shown in FIGS. 1 and 2 so that air discharged through the outlet 17 may be guided to the front of the outlet 17.

The air conditioner 1 may, through the blade 100, perform control to cause air from the blower fan 40 to be discharged through the plurality of holes 110*h* and 120*h* or be directly discharged through the outlet 17.

Figure 3:
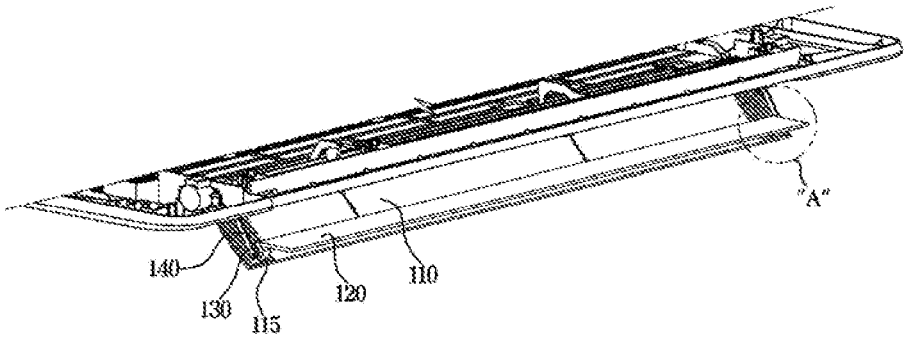
FIG. 3 is a perspective view illustrating a state of a blade that is rotated in the ceiling type air conditioner of FIG. 1.
Figure 4:
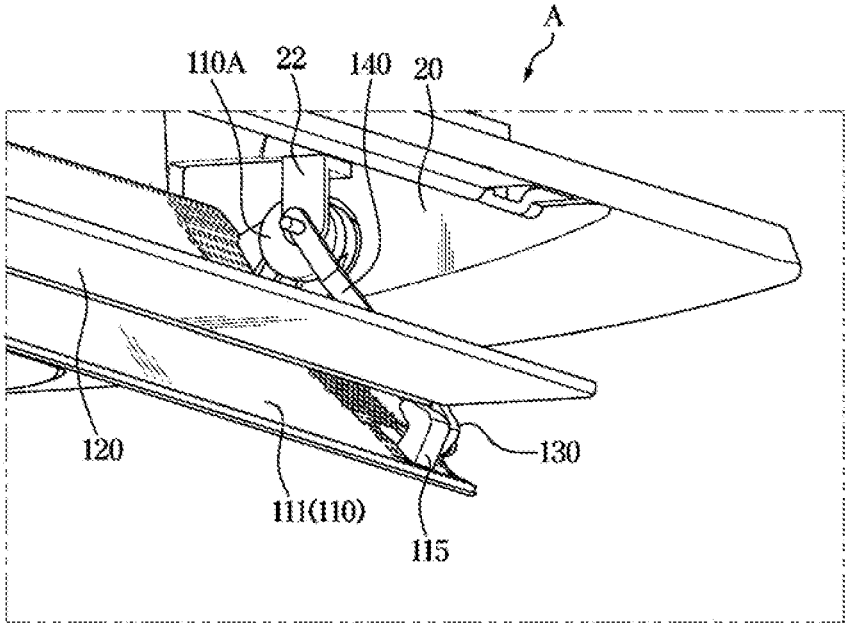
FIG. 4 is an enlarged view illustrating part 'A' of FIG. 3.
Figure 5:
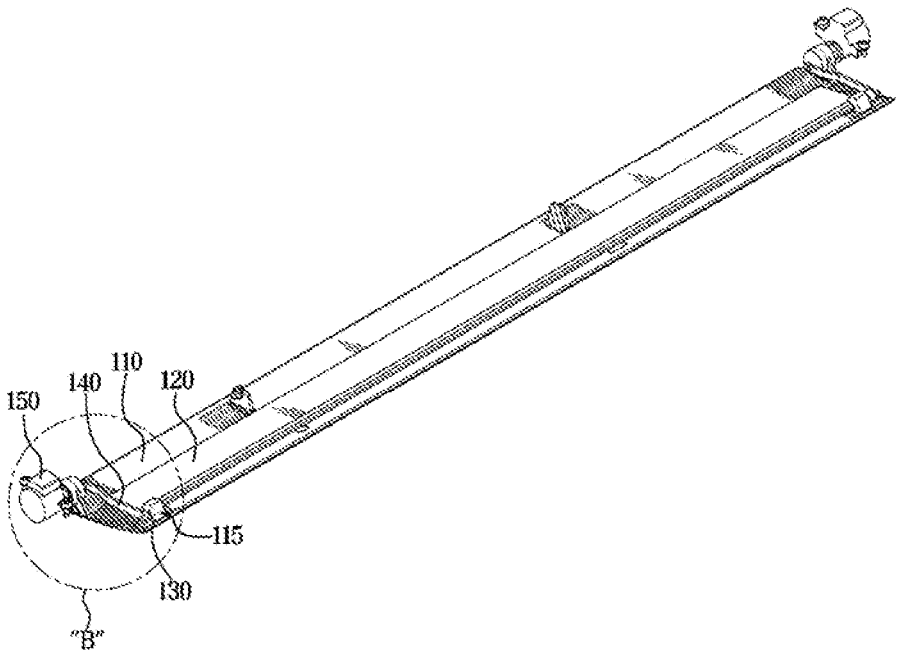
FIG. 5 is a perspective view illustrating the blade shown in FIG. 3.
Figure 6:
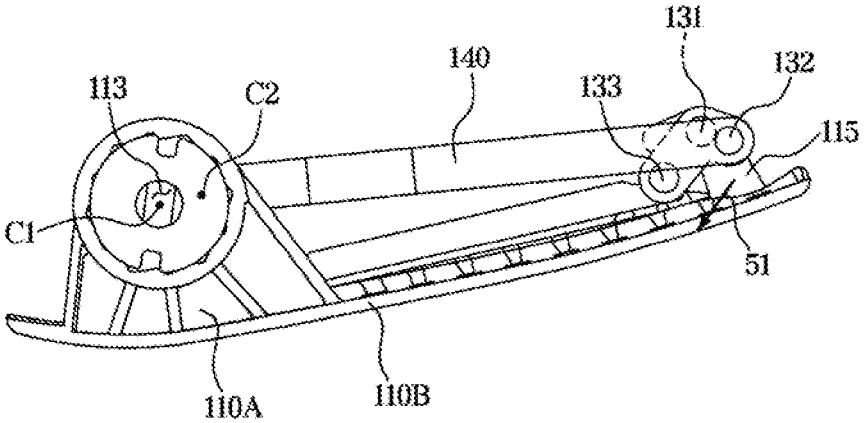
FIG. 6 is a side view illustrating the blade shown in FIG. 5.
Figure 7:
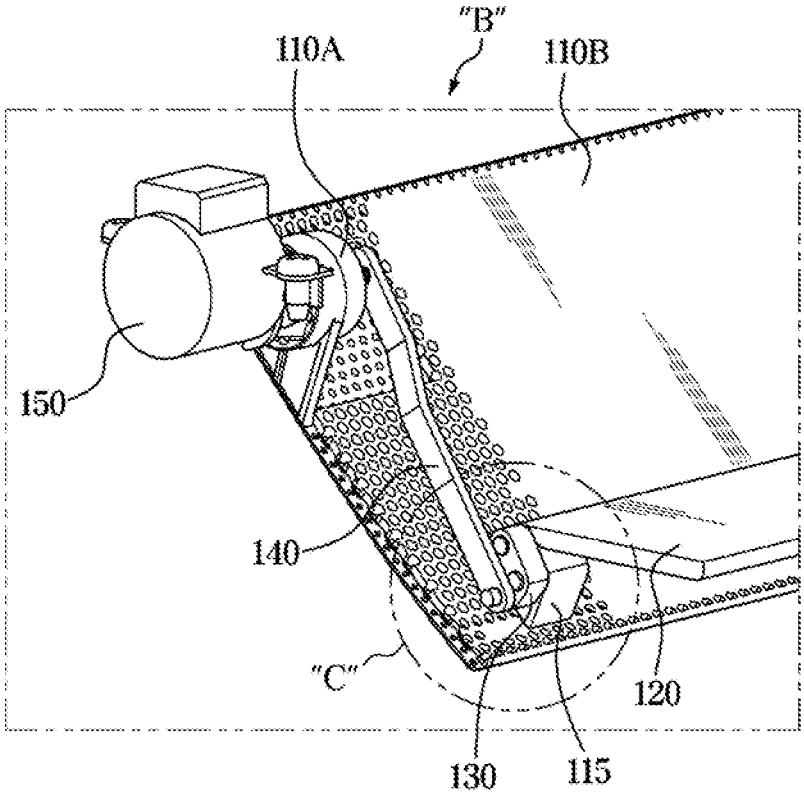
FIG. 7 is an enlarged view illustrating part 'B' of FIG. 5.
Figure 8:
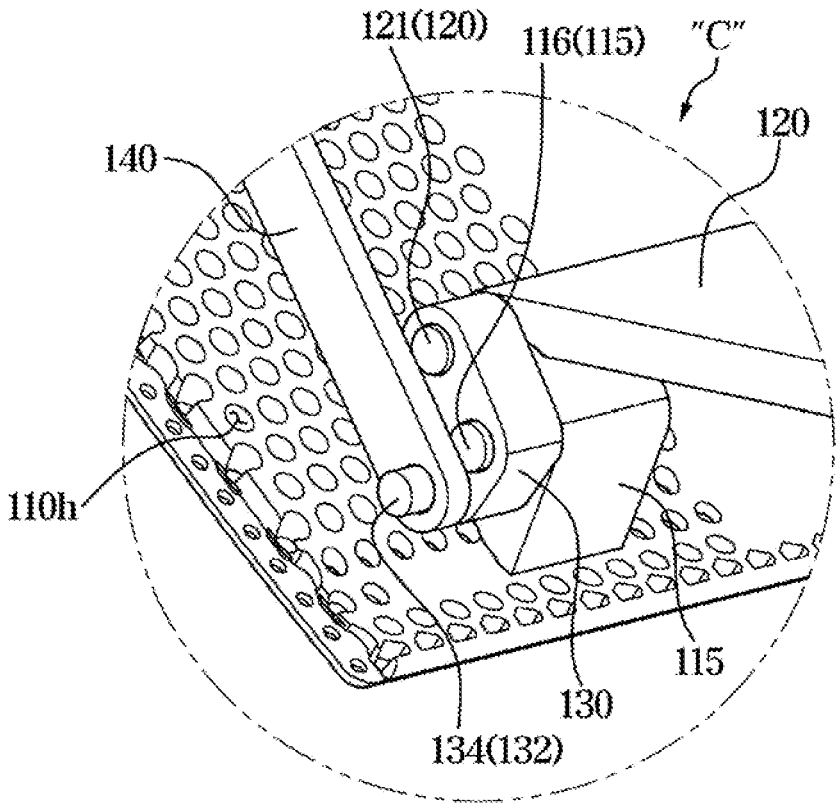
FIG. 8 is an enlarged view illustrating part 'C' of FIG. 7.
Figure 9:
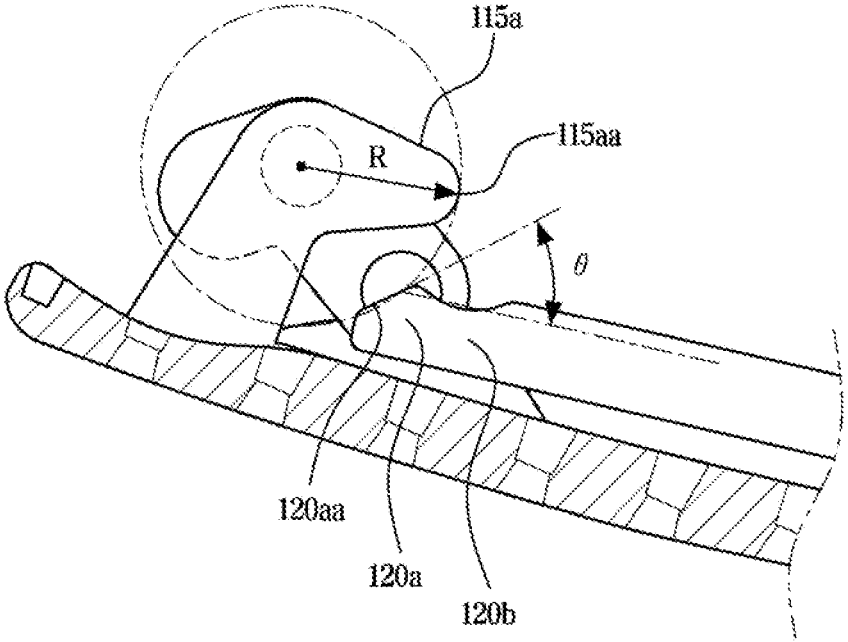
FIG. 9 is a schematic view illustrating a state in which a guide member and a sub-blade shown in FIG. 8 are in contact with each other.
Figure 10:
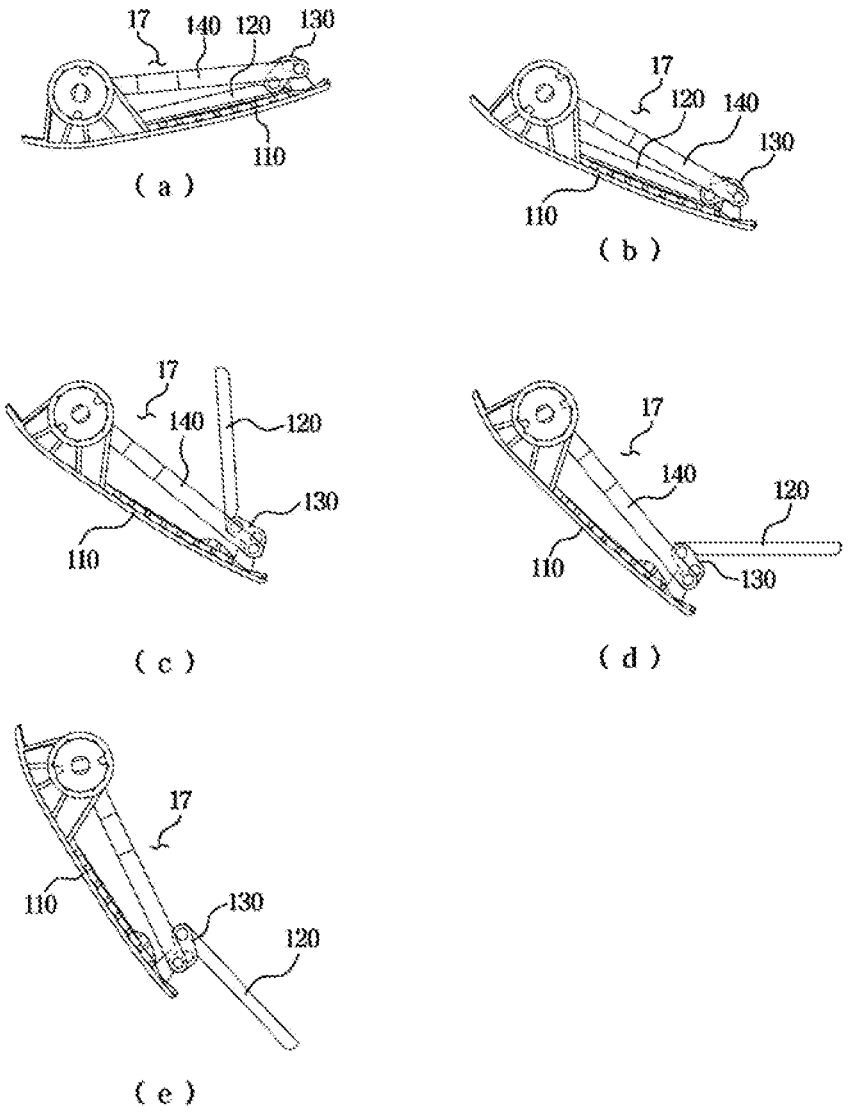
FIG. 10 is a schematic view illustrating an operation process of the blade in the ceiling type air conditioner of FIG. 1.

FIG. 3 is a perspective view illustrating a state of a blade that is rotated in the ceiling type air conditioner of FIG. 1, FIG. 4 is an enlarged view illustrating part 'A' of FIG. 3, FIG. 5 is a perspective view illustrating the blade shown in FIG. 3, FIG. 6 is a side view illustrating the blade shown in FIG. 5, FIG. 7 is an enlarged view illustrating part 'B' of FIG. 5, FIG. 8 is an enlarged view illustrating part 'C' of FIG. 7, FIG. 9 is a schematic view illustrating a state in which a guide member and a sub-blade shown in FIG. 8 are in contact with each other, and FIG. 10 is a schematic view illustrating an operation process of the blade in the ceiling type air conditioner of FIG. 1.

Referring to FIGS. 3 to 6, the blade 100 includes the main blade 110, a hinge 130, a connecting rod 140, and the sub-blade 120.

In order that opposite side ends of the sub-blade 120 are coupled to the main blade 110, each of the hinge 130, the connecting rod 140, and a guide member 115, which will be described below, may be provided as a pair.

The main blade 110 is coupled to a rotating shaft (not shown) and rotates with respect to a first rotation center C1. The main blade 110 includes a shaft coupling hole (113 in FIG. 6) for coupling of the rotating shaft. The main blade 110 includes the guide member 115 arranged at an end portion 111 thereof. The guide member 115 is provided to protrude from the end portion 111 of the main blade 110.

The hinge 130 is rotatably coupled to the guide member 115, so that the hinge 130 may be rotated on a coupling portion (a first rotation joint portion) in which the hinge 130 is coupled to the guide member 115.

The main blade 110 includes a coupling member 110A rotatably coupled to the rotating shaft, and a body member 110B connected to the coupling member 110A and provided in a plate shape. The coupling member 110A may be coupled to the rotating shaft and rotatable according to rotation of the rotating shaft. The body member 110B may include the plurality of holes 110*h* through which air may pass, and the guide member 115 may be provided on the body member 110B.

The connecting rod 140 may have one end rotatably coupled to the inner surface of the housing 20 and the other end rotatably coupled to the hinge 130. For example, as shown in FIG. 4, one side of the connecting rod 140 may be coupled to a support member 22 that is fixed to the coupling member 110A of the main blade 110. The support member 22 may be provided in a shape bent downward from the inner surface of the housing 20.

The connecting rod 140 may be provided to rotate with respect to a second rotation center C2. The connecting rod 140 may be coupled to the support member 22 such that the second rotation center C2 is positioned further forward than the first rotation center C1 of the main blade 110. The connecting rod 140 may allow the hinge 130 to rotate according to the rotation of the main blade 110, which will be described below.

The sub-blade 120 may be rotatably coupled to the hinge 130, and rotatable by being in contact with the guide member 115 of the main blade 110 according to the rotation of the hinge 130.

Referring to FIG. 7, the air conditioner 1 may further include a driving motor 150 for rotating the rotating shaft by transmitting a driving force to the rotating shaft. In this case, when a variable reluctance type stepping motor with excellent rotation angle resolution is used for the drive motor 150, a swing mode that requires not only a stepwise direction change of the blade 100, but also a continuous direction change of the blade 100 may be freely implemented. However, the present disclosure is not limited thereto, and any power unit may be used as the driving motor 150 as long as it can implement a stepwise direction change and continuous direction change of the blade 100.

Referring to FIGS. 6 and 8, the hinge 130 includes a first rotation joint portion 131 coupled to the guide member 115, a second rotation joint portion 132 coupled to the connecting rod 140, and a third rotation joint portion 133 coupled to the sub-blade 120.

The first rotation joint portion 131 may include a through hole (not shown) through which a joint 116 of the guide member 115 passes, the second rotation joint portion 132 may include a joint 134 that passes through a through hole (not shown) provided at the other end portion of the connecting rod 140, and the third rotation joint portion 133 may include a through hole (not shown) through which a joint 121 of the sub-blade 120 passes.

The connecting rod 140 may be provided such that the distance between the second rotation center C2 and the second rotation joint portion 132 is shorter than the distance between the first rotation center C1 and the first rotation joint portion 131. In this case, the hinge 130 may be rotated on the first rotation joint portion 131, and the first rotation joint portion 131 may be provided at a position higher than that of the second rotation joint portion 132.

Accordingly, when the main blade 110 is rotated, the connecting rod 140 rotates with a rotation radius smaller than that of the main blade 110, which causes the hinge 130 to be pulled in a first direction 51. As the connecting rod 140 pulls the periphery of the second rotation joint portion 132 of the hinge 130 in the first direction 51, the hinge 130 is caused to rotate clockwise on the first rotation joint portion 131.

Accordingly, the sub-blade 120 coupled to the hinge 130 through the third rotation joint portion 133 is rotated to come in contact with the guide member 115 of the main blade 110 according to the rotation of the hinge 130. The sub-blade 120, arranged to face the inner surface of the main blade 110, may be rotated in a direction away from the inner surface of the main blade 110. The sub-blade 120 may be caused to be arranged in parallel with the main blade 110 so as to guide the air further away.

Referring to FIG. 9, the guide member 115 may include a contact member 115*a* configured to be in contact the sub-blade 120 to guide the rotation of the sub-blade 120. The contact member 115*a* may include a contact surface 115*aa* having an arc shape.

The sub-blade 120 may include a contact portion 120*a* configured to be in contact with the contact member 115*a* of the guide member 115 and a panel portion 120*b* having a flat shape and extending from the contact portion 120*a*. The contact portion 120*a* may include a downward inclined surface 120*aa*. The downward inclined surface 120*aa* may be provided to form a predetermined angle θ with respect to the panel portion 120*b*.

When the sub-blade 120 is lifted according to the rotation of the hinge 130 so that the contact portion 120*a* of the sub-blade 120 comes in contact with the contact member 115*a* of the guide member 115, a maximum distance R from the first rotation joint portion 131 to the contact surface 115*aa* may be equal to the distance from the first rotation joint portion 131 to the downward inclined surface. In this case, the contact surface 115*aa* of the guide member 115 and the downward inclined surface 120*aa* of the sub-blade 120 come in contact with each other, so that the sub-blade 120 may be rotated along the guide member 115.

Referring to FIG. 10, in a state in which the main blade 110 closes the outlet 17, the sub-blade 120 is coupled to the main blade 110 through the hinge 130, and arranged to face the inner surface of the main blade 110 as shown in drawing (a) of FIG. 10.

In case the main blade 110 is rotated at a predetermined angle to open the outlet 17, the connecting rod 140 is provided such that the distance between the second rotation center C2 and the second rotation joint portion 132 is shorter than the distance between the first rotation center C1 and the first rotation joint portion 131, to thereby rotate the hinge 130 so that the sub-blade 120 is gradually lifted as shown in drawing (b) and (c) of FIG. 10.

In case the main blade 110 is rotated further downward, the sub-blade 120 is also rotated further and comes into contact with the guide member 115. In this case, when the sub-blade 120 is arranged to be directed forward of the outlet 17 as shown in (d), the rotation of the main blade 110 is stopped, so that air discharged to the outlet 17 may be guided to move forward of the outlet 17.

In this case, because the main blade 110 is rotated at a predetermined angle with respect to the outlet 17 such that air is discharged at a predetermined air volume and the sub-blade 120 is arranged to be directed forward, air may be guided forward of the outlet 17 while ensuring a sufficient amount of air volume compared to a general case in which a blade is arranged adjacent to the outlet 17 at a front side of the outlet 17.

When the main blade 110 and the sub-blade 120 are arranged as described above, cold air does not fall downward during the cooling operation of the air conditioner, thereby preventing occupants from being directly exposed to the air and having growing discomfort.

On the other hand, when the main blade 110 in the state shown in the drawing (d) is rotated further, the sub-blade 120 is also rotated further along the guide member 115, and thus arranged to be directed in the same direction as the main blade 110 as shown in drawing (e). When the main blade 110 and the sub-blade 120 are arranged as such, air discharged during the heating operation of the air conditioner may move downward far way rather than rising upward, thereby preventing a sensible temperature of occupants from being lowered in a space below the air conditioner in which occupants are located.

Figure 12:
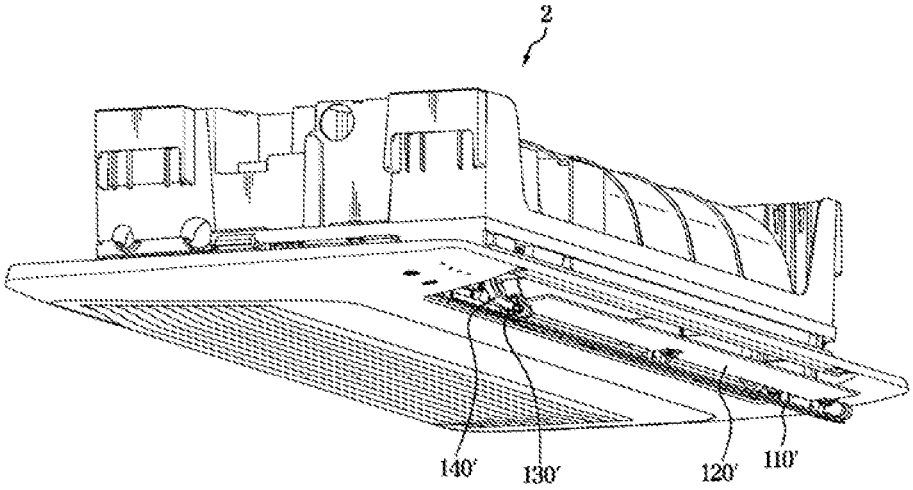
FIG. 12 is a perspective view illustrating a ceiling type air conditioner according to another embodiment of the present disclosure.
Figure 13:
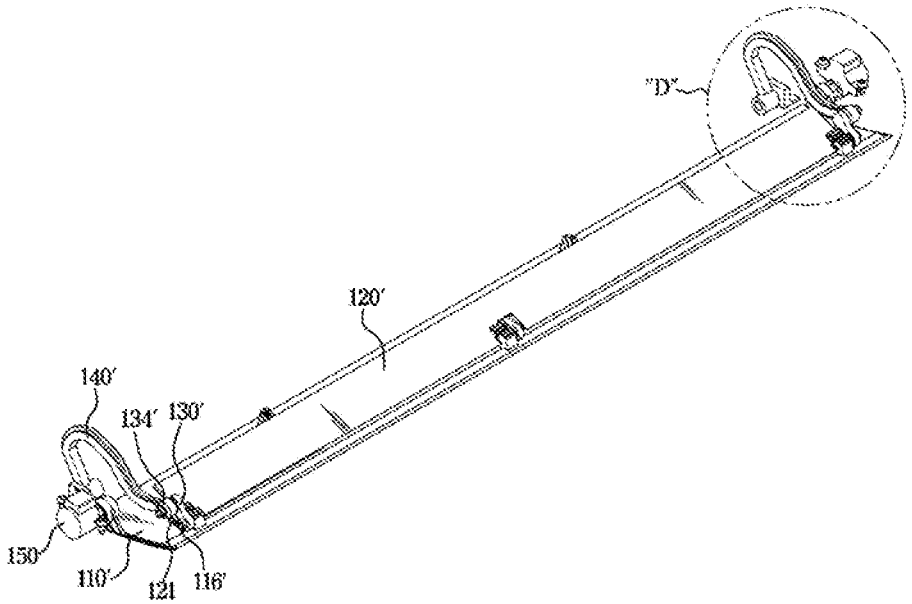
FIG. 13 is a perspective view illustrating a blade of the ceiling type air conditioner shown in FIG. 12.
Figure 14:
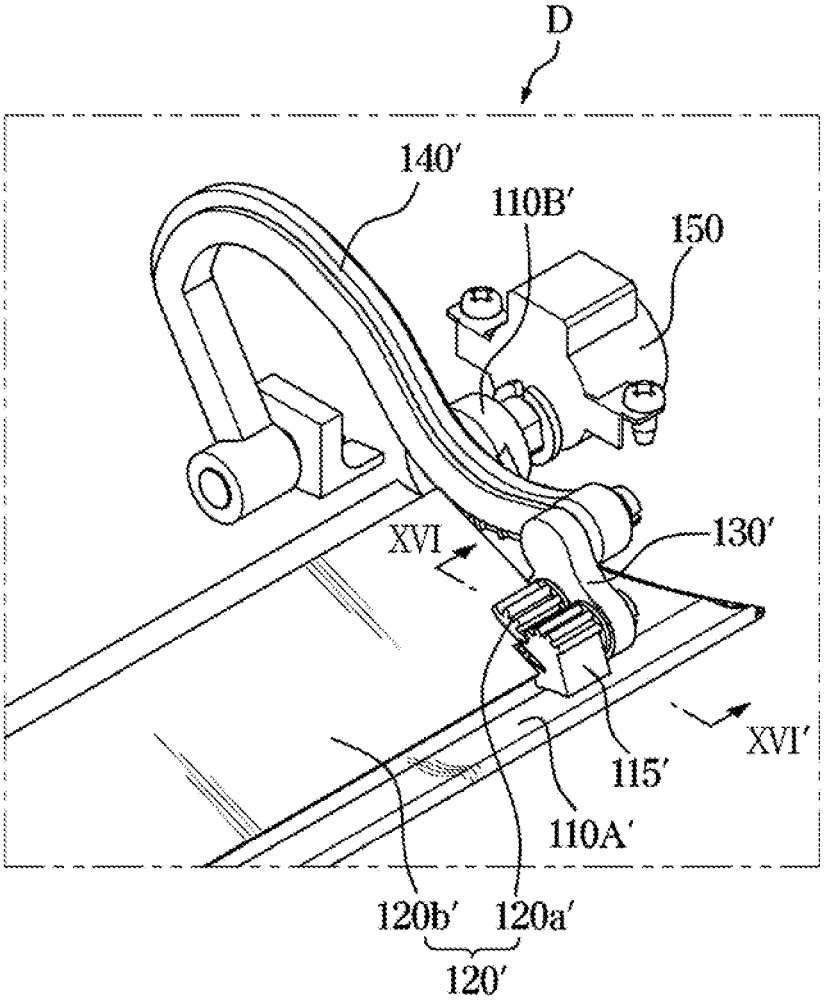
FIG. 14 is an enlarged view illustrating part 'D' of FIG. 13.
Figure 15:
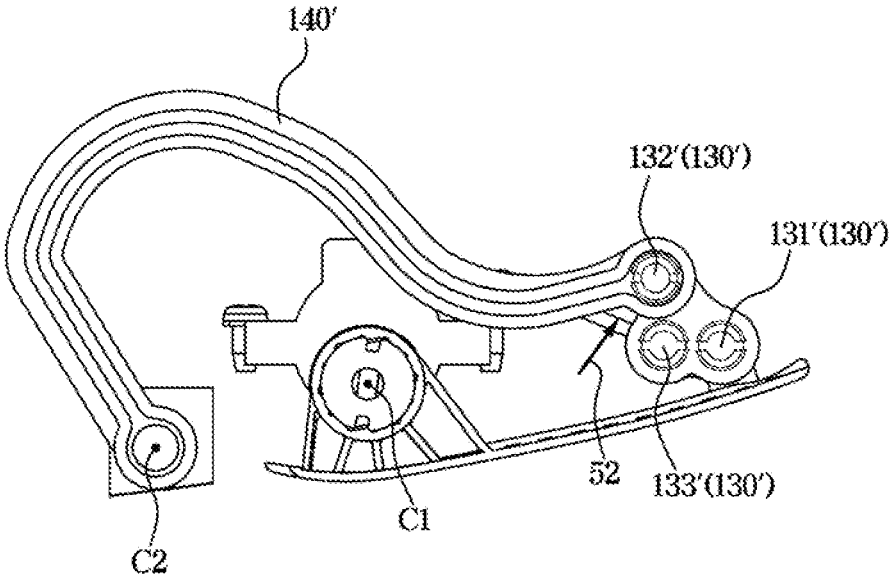
FIG. 15 is a side view illustrating the blade shown in FIG. 13.
Figure 16:
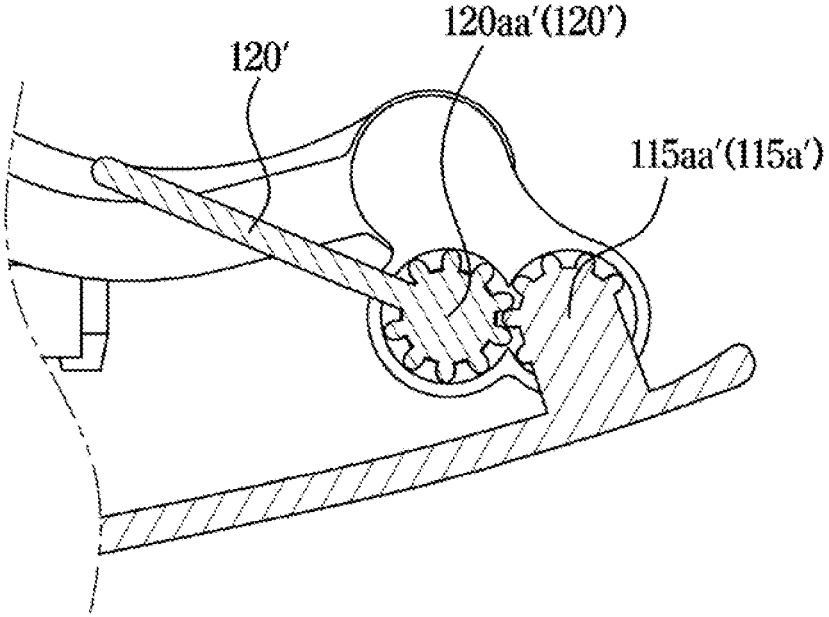
FIG. 16 is a cross-sectional view taken along line XVI-XVI' in FIG. 14.

FIG. 12 is a perspective view illustrating a ceiling type air conditioner according to another embodiment of the present disclosure, FIG. 13 is a perspective view illustrating a blade of the ceiling type air conditioner of FIG. 12, FIG. 14 is an enlarged view illustrating part 'D' of FIG. 13, FIG. 15 is a side view illustrating the blade shown in FIG. 13, and FIG. 16 is a cross-sectional view taken along line XVI-XVI' in FIG. 14.

Referring to FIGS. 12 to 16, a blade 100' includes a main blade 110', a hinge 130', a connecting rod 140', and a sub-blade 120'.

In order that opposite side ends of the sub-blade 120' are coupled to the main blade 110', each of the hinge 130', the connecting rod 140', and a guide member 115', which will be described below, may be provided as a pair.

The main blade 110' is coupled to a rotating shaft (not shown) and rotates with respect to a first rotation center C1. The main blade 110' includes a shaft coupling hole (113' in FIG. 15) to which the rotating shaft is coupled. The main blade 110' includes a guide member 115' arranged at an end portion 111' thereof. The guide member 115' is provided to protrude from the end portion 111' of the main blade 110'.

The hinge 130' is rotatably coupled to the guide member 115', so that the hinge 130' may be rotated on a coupling portion (a first rotation joint portion 131') in which the hinge 130' is coupled to the guide member 115'.

The main blade 110' includes a coupling member 110A' rotatably coupled to the rotating shaft, and a body member 1106' connected to the coupling member 110A' and provided in a plate shape. The coupling member 110A' is coupled to the rotating shaft and rotatable according to the rotation of the rotating shaft. The body member 1106' may include a plurality of holes through which air may pass, and the guide member 115' may be provided on the body member 110B'.

The connecting rod 140' may be provided to rotate with respect to a second rotation center C2 as shown in FIG. 15. The connecting rod 140' may be coupled to the housing 20 such that the second rotation center C2 is positioned further rearward than the first rotation center C1 of the main blade 110'.

In other end, the connecting rod 140' may have one end coupled to the inner surface of the housing 20 and the other end coupled to the hinge 130'. The one end of the connecting rod 140' may be position further rearward than the coupling member 110A' of the main blade 110'. The connecting rod 140' may allow the hinge 130' to rotate according to the rotation of the main blade 110', which will be described below.

The connecting rod 140' may be provided such that the distance between the second rotation center C2 and a second rotation joint portion 132' is greater than the distance between the first rotation center C1 and a first rotation joint portion 131'. The hinge 130' includes the first rotation joint portion 131' coupled to the guide member 115', the second rotation joint portion 132' coupled to the connecting rod 140', and a third rotation joint portion 133' coupled to the sub-blade 120'.

As illustrated in FIG. 13, the first rotation joint portion 131' may include a through hole (not shown) through which a joint 116' of the guide member 115' passes, the second rotation joint portion 132' may include a joint 134' that passes through a through hole (not shown) provided at the other end portion of the connecting rod 140', and the third rotation joint portion 133' may include a through hole (not shown) through which a joint 121 of the sub-blade 120' passes.

In this case, the hinge 130' may be rotated on the first rotation joint portion 131', and the first rotation joint portion 131' may be provided at a position lower than that of the second rotation joint portion 132'.

Because the distance between the second rotation center C2 and the second rotation joint portion 132' is greater than the distance between the first rotation center C1 and the first rotation joint portion 131', rotation of the main blade 110' may allow the connecting rod 140' to push the periphery of the second joint portion 132' of the hinge 130' in the second direction 52, which causes the hinge 130' to be rotated.

The sub-blade 120' is rotated according to the rotation of the hinge 130' such that the sub-blade 120' arranged to face the inner surface of the main blade 110' is rotated in a direction away from the inner surface of the main blade 110'.

Referring to FIG. 16, the guide member 115' may include a contact member 115*a*' configured to be in contact with the sub-blade 120' to guide the rotation of the sub-blade 120'. The contact member 115*a*' may include a first gear 115*aa*' provided in a tooth shape.

The sub-blade 120 includes a contact portion 120*a*' configured to be in contact with the contact member 115*a*' of the guide member 115' and a panel portion 120*b*' extending from the contact portion 120*a*'. The contact portion 120*a*' may include a second gear 120*aa*' provided to be meshed with the first gear 115*aa*'. When the sub-blade 120' is rotated according to the rotation of the hinge 130' and the contact portion 120*a*' of the sub-blade 120' thus comes in contact with the contact member 115*a*' of the guide member 115', the second gear 120*aa*' and the first gear 115*aa*' are meshed with each other. The sub-blade 120' may be rotated at a constant speed along the first gear 115*aa*' through the second gear 120*aa*', so that the sub-blade 120' may perform a stable rotation without being rotated in a reverse direction, that is, a direction oriented toward the inner side of the main blade 110'.

The guide member 115' and the contact portion 120*a*' of the sub-blade 120' may be applied to the air conditioner 1 described with reference to FIGS. 1 to 10, and the air conditioner 2 may also adopt the guide member 115 and the contact portion 120*a* of the sub-blade 120 described with reference to FIGS. 1 to 10.

Figure 17:
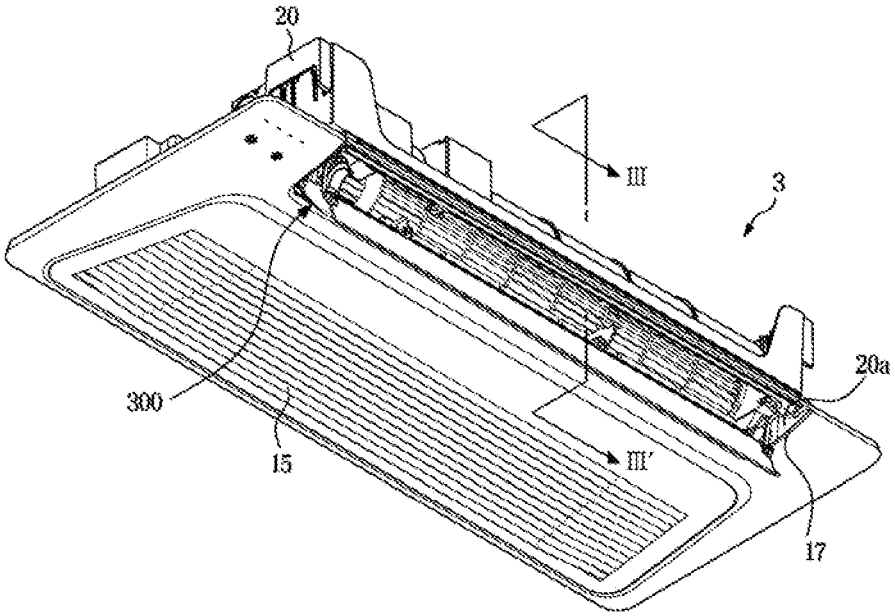
FIG. 17 is a perspective view illustrating a ceiling type air conditioner according to another embodiment of the present disclosure.
Figure 18:
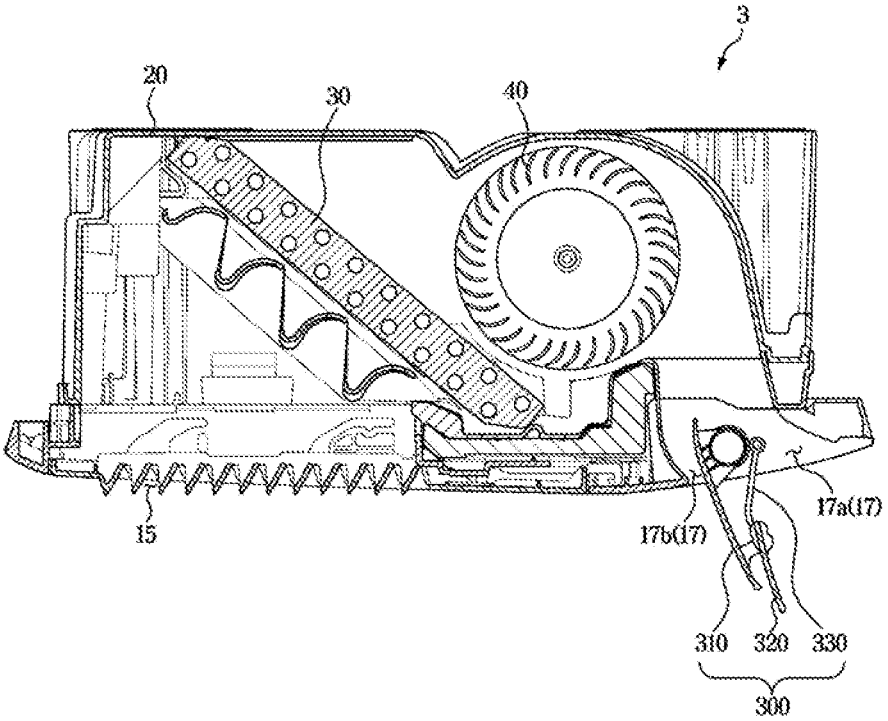
FIG. 18 is a cross-sectional view taken along line III-III' in FIG. 17.
Figure 19:
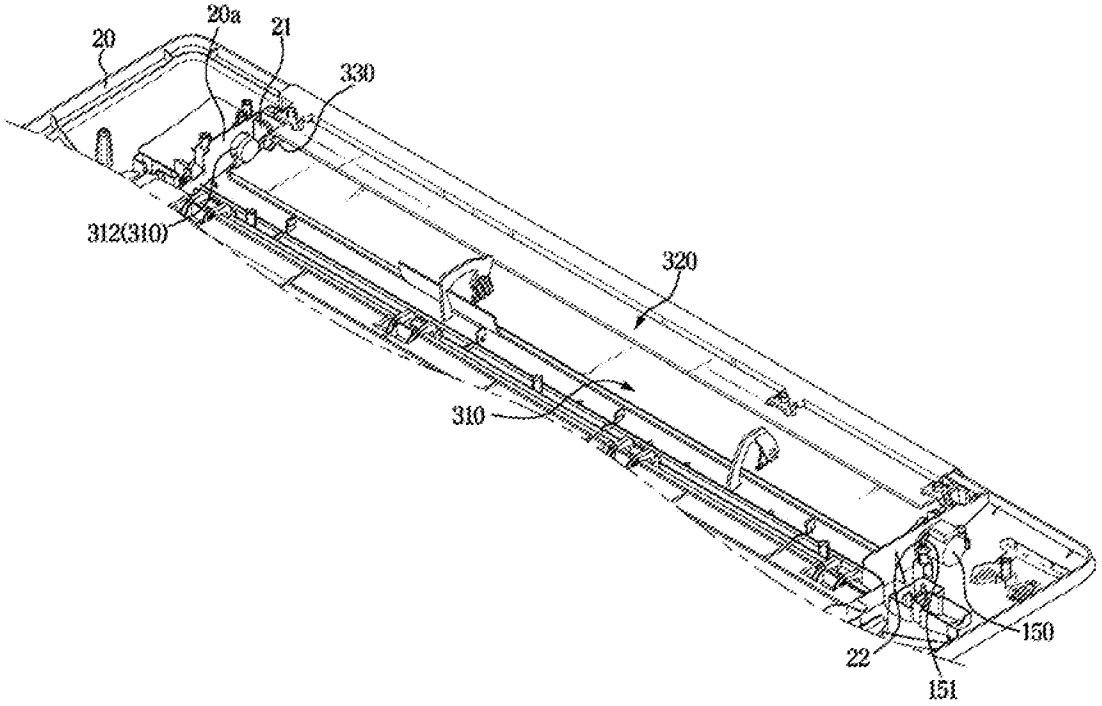
FIG. 19 is a view schematically illustrating a coupling relationship between a housing and a blade of the air conditioner shown in FIG. 17.
Figure 20:
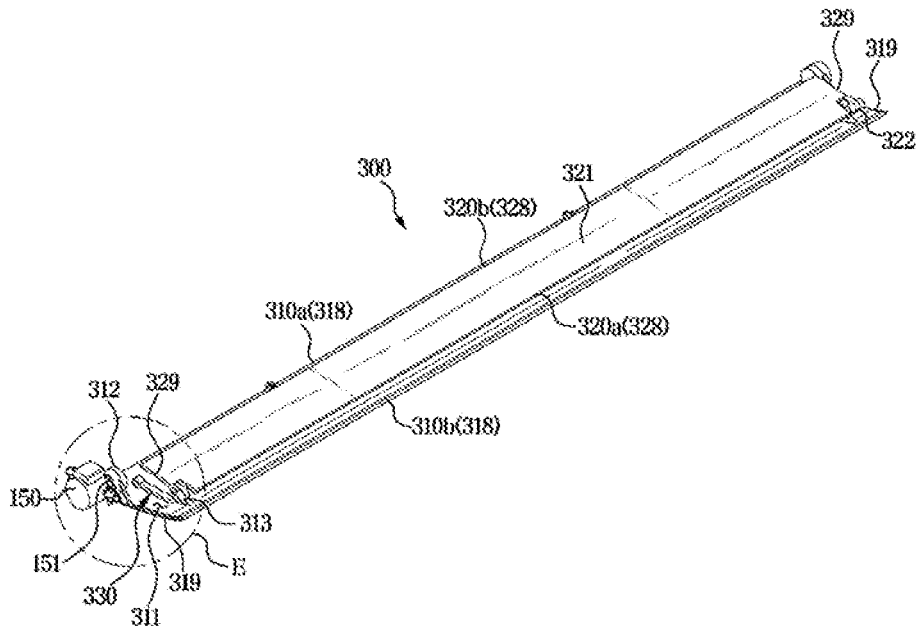
FIG. 20 is a perspective view illustrating a blade of the air conditioner shown in FIG. 17.
Figure 21:
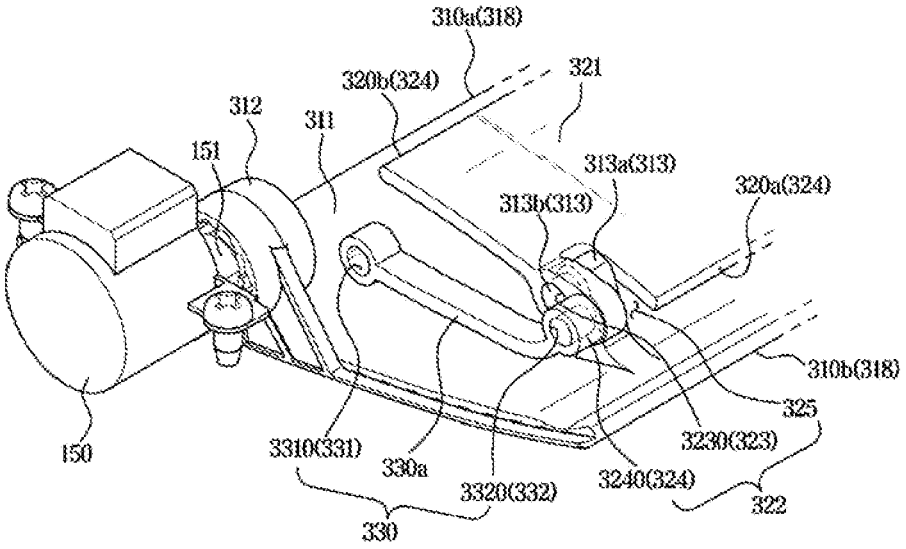
FIG. 21 is an enlarged view illustrating part 'E' of FIG. 20.
Figure 22:
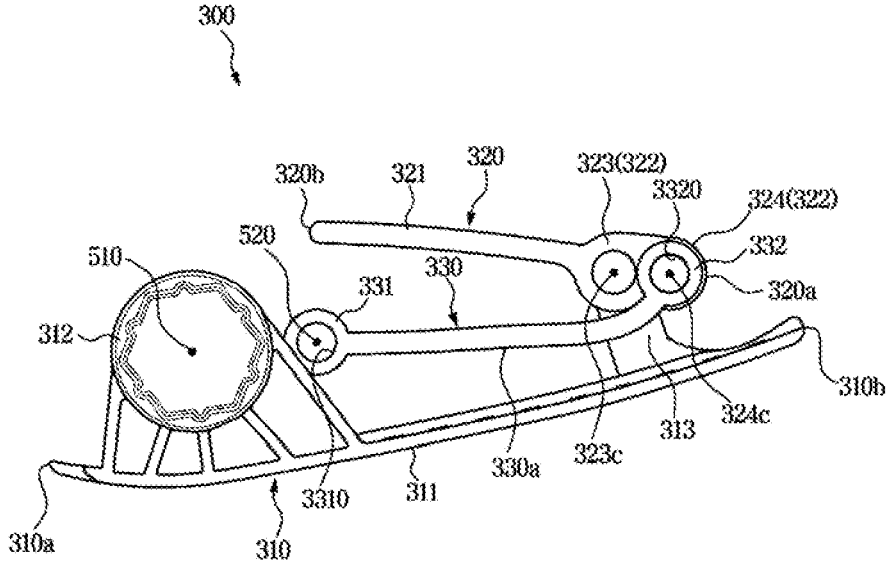
FIG. 22 is a side view illustrating the blade shown in FIG. 20.
Figure 23:
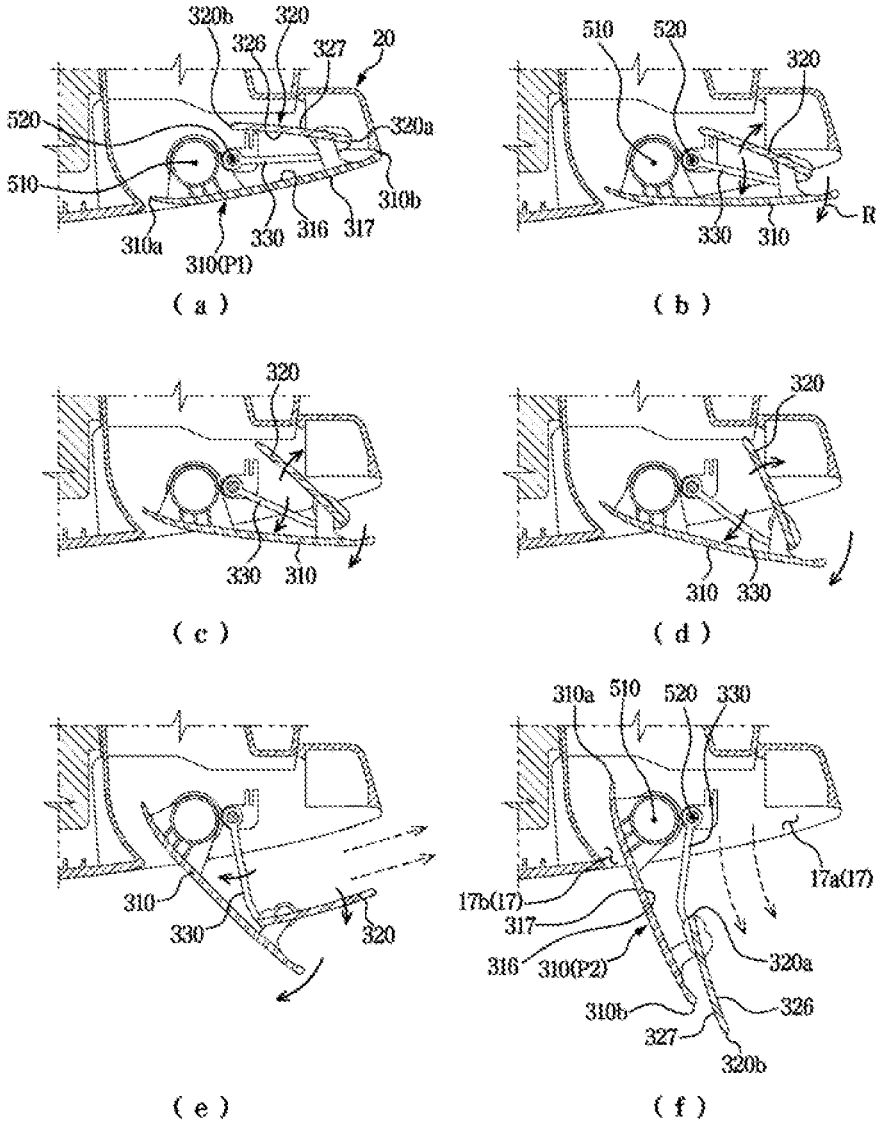
FIG. 23 is a schematic view illustrating an operation process of the blade in the air conditioner of FIG. 17.

FIG. 17 is a perspective view illustrating a ceiling type air conditioner according to another embodiment of the present disclosure, FIG. 18 is a cross-sectional view taken along line III-III' in FIG. 17, FIG. 19 is a view schematically illustrating a coupling relationship between a housing and a blade of the air conditioner shown in FIG. 17, FIG. 20 is a perspective view illustrating a blade of the air conditioner shown in FIG. 17, FIG. 21 is an enlarged view illustrating part 'E' of FIG. 20, FIG. 22 is a side view illustrating the blade shown in FIG. 20, and FIG. 23 is a schematic view illustrating an operation process of the blade in the air conditioner of FIG. 17.

Hereinafter, an air conditioner 3 according to another embodiment of the present disclosure will be described. In the following description, parts performing substantially the same function will be assigned the same reference numeral, and details of parts that are identical or equivalent to those of the air conditioner 1 described above will be omitted.

Compared with the blade unit 100 of the air conditioner 1 described above, a blade unit 300 of the air conditioner 3 includes a main blade 310 and a sub-blade 320 that are directly connected to each other without a hinge 130. Accordingly, the blade unit 300 may be provided with a simpler structure, and the manufacture and/or installation of the air conditioner 3 may be facilitated. In addition, there is a benefit of cost savings.

Referring to FIGS. 17 to 19, the air conditioner 3 may include the blade unit 300 for guiding air discharged to the outlet 17.

The blade unit 300 may include the main blade 310, the sub-blade 320, and a guide link 330.

The main blade 310 may be rotatably provided to adjust the opening/closing range of the outlet 17. The main blade 310 may rotate with respect to a first rotation center 510. The main blade 310 may rotate in one direction R.

The main blade 310 may rotate within a predetermined angle range. For example, the main blade 310 may rotate between a first position P1 and a second position P2.

For example, when the main blade 310 is in the first position P1, the air conditioner 3 may be in an OFF state or a windless operation state (see drawing (a) in FIG. 23). When the main blade 310 is in the first position P1, the main blade 310 may be provided to close the outlet 17. In addition, when the main blade 310 is in the second position P2, the air conditioner 3 may be in a speed operation state (see drawing (f) in FIG. 23). That is, when the main blade 310 is in the second position P2, the main blade 310 may be provided to maximally open the outlet 17. In this case, the air may be discharged from the outlet 17 at a high speed, and reach a longer distance. Details thereof will be described below.

Referring to FIGS. 20 to 22, the main blade 310 may include a main blade body 311, a motor coupling portion 312, and a sub-blade coupling portion 313.

The main blade body 311 may guide the air discharged through the outlet 17. The main blade body 311 may have a substantially plate shape. For example, the main blade body 311 may include a rectangular shape having a pair of long sides 318 and a pair of short sides 319.

When the main blade 310 is in the first position P1, a side of the main blade body 311 in which the long side 318 adjacent to the inlet 15 is arranged may be referred to as one side 310*a* of the main blade 310, and a side of the main blade body 311 in which the long side 318 distant from the inlet 15 is arranged may be referred to as the other side 310*b* of the main blade 310. That is, the one side 310*a* of the main blade 310 may be provided further rearward than the other side 310*b*.

When the main blade 310 is in the first position P1, a surface of the main blade body 311 directed to the inside of the housing 20 may be referred to as a first surface 316 of the main blade 310, and a surface of the main blade body 311 directed to the outside of the housing 20 may be referred to as a second surface 317 of the main blade 310.

The motor coupling portion 312 may be provided to receive a rotation force from a motor 150. The motor coupling portion 312 may be coupled to a rotating shaft 151 of the motor 150 to receive a rotation force from the motor 150. The main blade 310 may be provided to rotate with respect to the first rotation center 510 formed by the rotating shaft 151.

In the drawings, the motor 150 is illustrated as being coupled to only one of the motor coupling portions 312 provided at opposite end portions of the main blade 310, but the present disclosure is not limited thereto. The motor 150 may be connected to the opposite end portions of the main blade 310.

The motor coupling portion 312 may extend upward from the main blade body 311. For example, the motor coupling portion 312 may be provided on the one side 310*a* of the main blade 310. The motor coupling portion 312 may be arranged adjacent to the one side 310*a* of the main blade 310 than the sub-blade coupling portion 313 is.

The sub-blade coupling portion 313 may be coupled to the sub-blade 320. The sub-blade coupling portion 313 may extend upward from the main blade body 311. For example, the sub-blade coupling portion 313 may be provided on the other side 310*b* of the main blade 310. The sub-blade coupling portion 313 may be arranged adjacent to the other side 310*b* of the main blade 310 than the motor coupling portion 312 is.

The sub-blade coupling portion 313 may include a coupling body 313*a* and a protrusion 313*b* extending from the coupling body 313*a*. For example, the coupling body 313*a* may be positioned in a cutout portion 325 of the sub-blade 320 to be described below, and the protrusion 313*b* may be coupled to a first joint portion 323 of the sub-blade 320 to be described below.

The main blade 310 may further include a plurality of first discharge holes (not shown) passing through the main blade body 311. In a state in which the main blade 310 closes the outlet 17 (see drawing (a) in FIG. 23), air may be discharged to the outside of the housing 20 through the plurality of first discharge holes.

The sub-blade 320 may be provided to operate in association with rotation of the main blade 310. For example, the sub-blade 320 may be rotatably coupled to the main blade 310. The sub-blade 320 may be provided to rotate in the same direction as the main blade 310. As the sub-blade 320 rotates, the discharge direction of the air discharged to the outlet 17 may be adjusted.

Referring to FIGS. 20 to 22, the sub-blade 320 may include a sub-blade body 321.

The sub-blade body 321 may guide the air discharged through the outlet 17. The sub-blade body 321 may have a substantially plate shape. For example, the sub-blade body 321 may include a rectangular shape having a pair of long sides 328 and a pair of short sides 329.

In case the main blade 310 is in the first position P1, a side of the sub-blade body 321 in which the long side 328 distant from the inlet 15 is arranged may be referred to as one side 320*a* of the sub-blade 320, and a side of the sub-blade 320 211 in which the long side 328 adjacent to the inlet 15 is arranged may be referred to as the other side 320*b* of the sub-blade 320. For example, when the main blade 310 is in the first position P1, the one side 320*a* of the sub-blade 320 may be provided forward than the other side 320*b*. Conversely, when the main blade 310 is in the second position P2, the one side 320*a* of the sub-blade 320 may be provided further rearward than the other side 320*b*.

In case the main blade 310 is in the first position P1, a surface of the sub-blade body 321 directed toward the main blade 310 may be referred to as a first surface 326 of the sub-blade 320, and a surface of the sub-blade body 321 opposite to the first surface 326 may be referred to as a second surface 327.

The sub-blade 320 may be provided to be coupled to the main blade 310. The sub-blade 320 may be provided to be coupled to the guide link 330. The sub-blade 320 may include a connection portion 322 coupled to the main blade 310 and the guide link 330.

The connection portion 322 may include the first joint portion 323 rotatably coupled to the main blade 310. For example, the first joint portion 323 may include a coupling hole 3230 coupled to the protrusion 313*b* of the sub-blade coupling portion 313. The connection portion 322 may include a second joint portion 324 rotatably coupled to the guide link 330. For example, the second joint portion 324 may include a coupling protrusion 3240 coupled to a second hole 3320 of a second end portion 332 of the guide link 330. However, the coupling method of the connection portion 322 is not limited to the above-described example, and the sub-blade 320 may be rotatably coupled to the main blade 310 and the guide link 330 in various ways.

The connection portion 322 may further include the cutout portion 325 that is a predetermined portion cut from the one side 320*a* toward the other side 320*b* of the sub-blade 320. The coupling body 313*a* of the main blade 310 may be positioned in the cutout portion 325.

The connection portion 322 may be provided on the one side 320*a* of the sub-blade 320.

The sub-blade 320 may be provided to rotate in association with the rotation of the main blade 310.

The sub-blade 320 may be provided to be unfolded according to the rotation of the main blade 310. For example, when the main blade 310 is in the first position P1, the entire sub-blade 320 is provided to overlap the main blade 310, and when the main blade 310 is positioned in the second position P2, a part of the sub-blade 320 is provided to overlap the main blade 310.

The blade unit 300 includes the sub-blade 320 so that the total area for guiding air may increase. For example, the air discharged through the outlet 17 may be guided not only by the main blade 310 but also by the sub-blade 320, and thus reach a longer distance. That is, the sub-blade 320 may increase the reachable distance of air discharged through the outlet.

As the sub-blade 320 rotates, the one side 320*a* of the sub-blade 320 may become closer to the first rotation center 510 of the main blade 310, and the other side 320*b* of the sub-blade 320 may become distant from the first rotation center 510 of the main blade 310.

The sub-blade 320 may further include a plurality of second discharge holes (not shown) passing through the sub-blade body 321. In a state in which the main blade 310 closes the outlet 17 (see drawing (a) in FIG. 23), air may be discharged to the outside of the housing 20 through the plurality of second outlet holes of the sub-blade 320 and the plurality of first outlets of the main blade 310. Accordingly, the air conditioner 3 may implement a windless airflow.

The guide link 330 may be provided to guide a movement of the sub-blade 320. For example, the guide link 330 may be connected to the one side 320*a* of the sub-blade 320 to guide the movement of the sub-blade 320. The guide link 330 may be provided to rotate with respect to a second rotation center 520 in association with the rotation of the main blade 310.

The guide link 330 may include a link body 330*a*, a first end portion 331 provided at one end of the link body 330*a*, and a second end portion 332 provided at the other end of the link body 330*a*.

The first end portion 331 of the guide link 330 may be provided to form the second rotation center 520. The first end portion 331 may be provided to be rotatably coupled to the inside of the housing 20. For example, referring to FIG. 19, the first end portion 331 may include a first hole 3310 coupled to a link coupling portion 21 protruding from an inner surface 20*a* of the housing 20.

The second end portion 332 of the guide link 330 may be provided to be coupled to the sub-blade 320. The second end portion 332 may be provided to be coupled to the second joint portion 324 of the sub-blade 320. For example, the second end portion 332 may include a second hole 3320 coupled to the coupling protrusion 3240 of the second joint portion 324.

The distance between the second rotation center 520 and the second joint portion 324 may be provided to be shorter than the distance between the first rotation center 510 and the first joint portion 323. Accordingly, the guide link 330 may guide the movement of the sub-blade 320 such that the sub-blade 320 rotates in the same direction as the main blade 310.

Hereinafter, an operation process of the blade unit 300 will be described with reference to FIG. 23.

Referring to drawing (a) of FIG. 23, the main blade 310 may be provided in the first position P1. In this case, the air conditioner 3 is in a non-operational state (OFF state), or in a windless driving state in which air is discharged through the plurality of first discharge holes (not shown) of the main blade 310 and the plurality of second discharge holes (not shown) of the sub-blade 320. In this case, the first joint portion 323 of the sub-blade 320 may be located further upward than the second joint portion 324.

Referring to FIG. 23, the main blade 310 may receive a rotation force from the motor 150 and rotate in one direction R. As the main blade 310 rotates, the sub-blade 320 may also rotate in the one direction R. The guide link 330 coupled to the sub-blade 320 may also rotate in the one direction R in association with the rotation of the main blade 110. In this case, the guide link 330 may guide the rotation of the sub-blade 320 such that the second joint portion 324 of the sub-blade 320 becomes closer to the first rotation center 510. Accordingly, the second joint portion 324 of the sub-blade 320 may rotate while moving in a downward direction, and the first joint portion 323 may rotate while moving in an upward direction. As the connection portion 322 provided on the one side 320*a* of the sub-blade 320 rotates, the other side 320*b* of the sub-blade 320 may be provided to be unfolded toward the outside of the housing 20. In result, as the main blade 310 and the sub-blade 320 rotate, the angle between the main blade 310 and the sub-blade 320 may increase. Here, the angle between the main blade 310 and the sub-blade 320 may be an angle between the first surface 316 of the main blade 310 and the first surface 326 of the sub-blade 320.

The sub-blade 320 may control the discharge direction of the air discharged through the outlet 17. Accordingly, the air conditioner 3 may control the airflow direction at various angles.

Referring to drawing (e) of FIG. 23, the sub-blade 320 may guide the airflow such that the air is discharged in an approximately horizontal direction. For example, because cold air has a characteristic of falling downward, discomfort may increase when an occupant directly encounters the air. During the cooling operation of the air conditioner, the blade unit 300 is provided as shown in the drawing (e) of FIG. 12 to thereby transmit the air far away in the horizontal direction. However, the present disclosure is not limited thereto, and even during the heating operation of the air conditioner 3, the blade unit 300 may be provided as shown in (e) of FIG. 23.

Referring to (f) of FIG. 23, the sub-blade 320 may guide the airflow such that the air is discharged in an approximately vertical downward direction. For example, because warm air has a characteristic of rising upward, the sensible temperature may be low in a lower space in which the occupant is located. During the heating operation of the air conditioner 3, the blade unit 300 may be provided as shown in drawing (f) of FIG. 23 to thereby transmit the air far away in the downward direction. However, the present disclosure is not limited thereto, and the blade unit 300 may be provided as shown in drawing (f) of FIG. 23 for rapid cooling even during the cooling operation of the air conditioner.

Meanwhile, referring to drawing (f) of FIG. 23, the main blade 310 may be provided in the second position P2. In this case, the air conditioner 3 may be in a speed operation state. As described above, the blade unit 300 may transmit air discharged through the outlet 17 far away in the downward direction such that rapid indoor heating or rapid indoor cooling may be achieved. In this case, the second joint portion 324 of the sub-blade 320 may be located further upward than the first joint portion 323. In addition, the first surface 326 of the sub-blade 320 may be provided to guide the air discharged through the outlet 17, and a portion of the second surface 327 of the sub-blade 320 may be provided to be directed toward the first surface 316 of the main blade 310.

When the main blade 310 is in the second position P2, the opening degree of the outlet 17 may be maximized. For example, the angle between the main blade 310 and the sub-blade 320 may be provided in a range of approximately 120° to 190°. However, the present disclosure is not limited thereto, and the angle between the main blade 310 and the sub-blade 320 may be approximately 190° or more.

As described above, the blade unit 300 may guide the air discharged to the outlet 17 in various ways.

The blade unit 300 may be driven in a first mode for discharging air through the plurality of first discharge holes of the main blade 310 and the plurality of second discharge holes of the sub-blade 320 (see drawing (a) in FIG. 23). When the blade unit 300 is driven in the first mode, the air conditioner 3 may implement a windless airflow.

The blade unit 300 may be driven in a second mode for guiding the air discharged to the outlet 17 in a vertical downward direction (see (f) of FIG. 23). For example, during a heating operation of the air conditioner 3, the blade unit 300 may be driven in the second mode. In this case, the blade unit 300 may allow warm air discharged through the outlet 17 to easily reach the lower space of the room so that the heating effect may be enhanced. However, the present disclosure is not limited thereto, and even during the cooling operation of the air conditioner 3, the second mode driving of the blade unit 300 may be performable.

The blade unit 300 may be driven in a third mode for guiding the air discharged to the outlet 17 in a horizontal direction (see (e) of FIG. 23). For example, during the cooling operation of the air conditioner 3, the blade unit 300 may be driven in the third mode. In this case, the blade unit 300 may guide the cold air discharged through the outlet 17 in the horizontal direction, so that the cold air does not directly contact the occupants. Thereby, the occupant's comfort may be improved. However, the present disclosure is not limited thereto, and even during the heating operation of the air conditioner 3, the third mode driving of the blade unit 300 may be performable.

Figure 24:
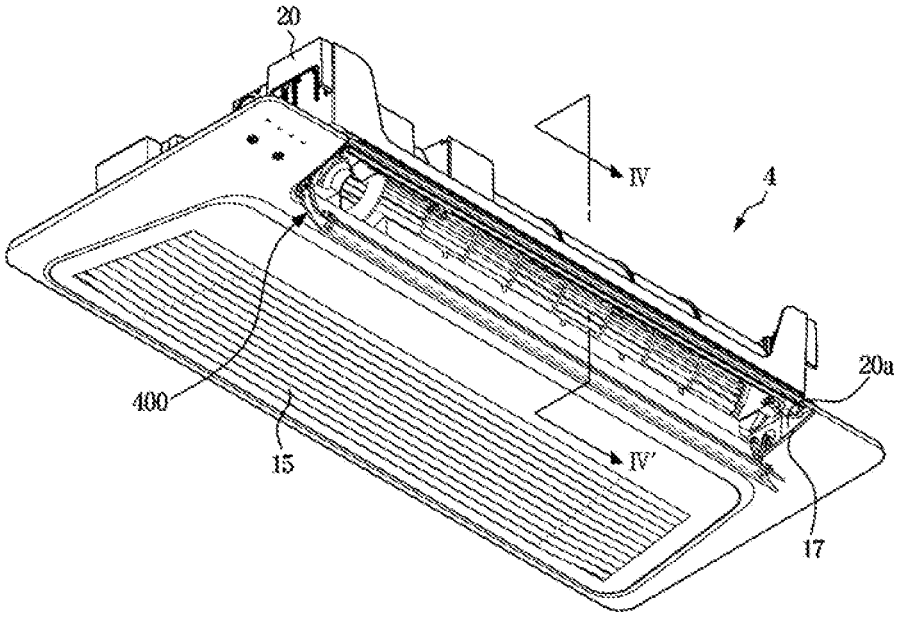
FIG. 24 is a perspective view illustrating a ceiling type air conditioner according to still another embodiment of the present disclosure.
Figure 25:
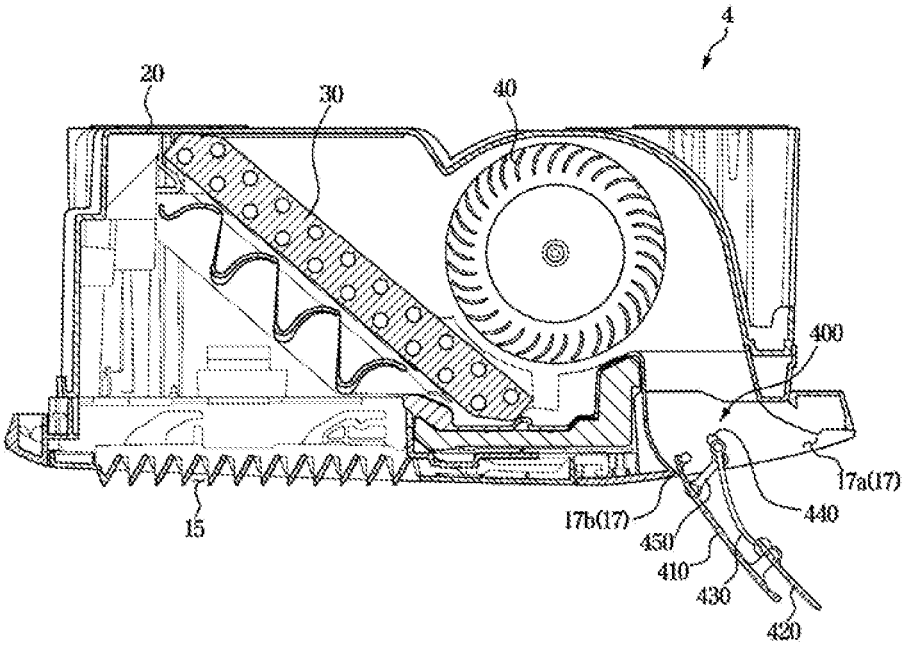
FIG. 25 is a cross-sectional view taken along line IV-IV' in FIG. 24.
Figure 26:
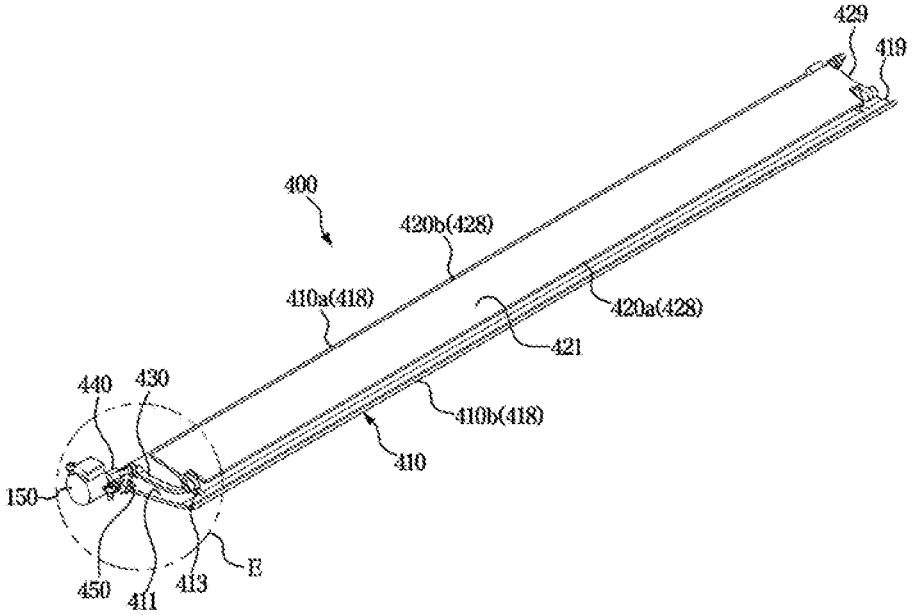
FIG. 26 is a perspective view illustrating a blade of the air conditioner shown in FIG. 24.
Figure 27:
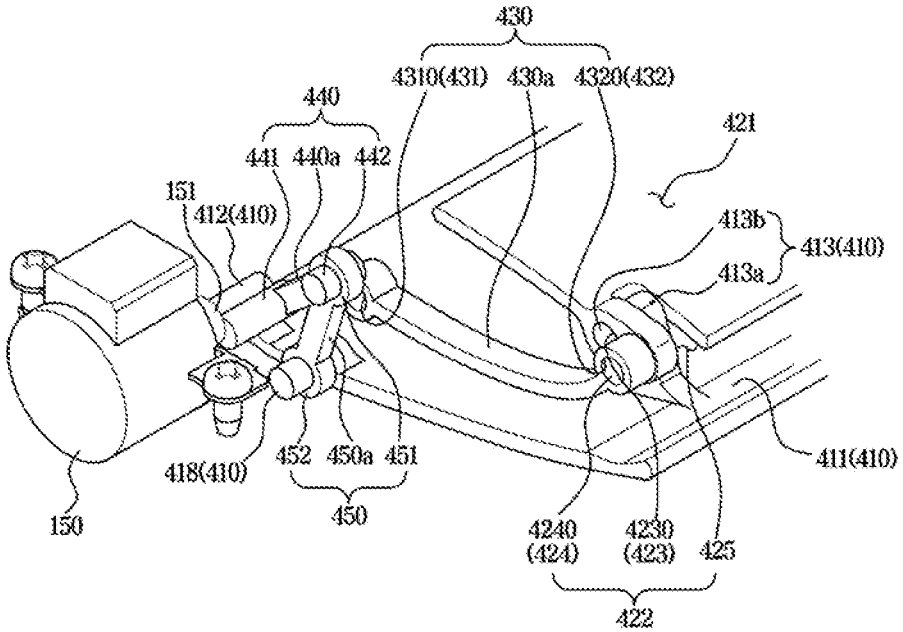
FIG. 27 is an enlarged view illustrating part 'F' shown in FIG. 26.
Figure 28:
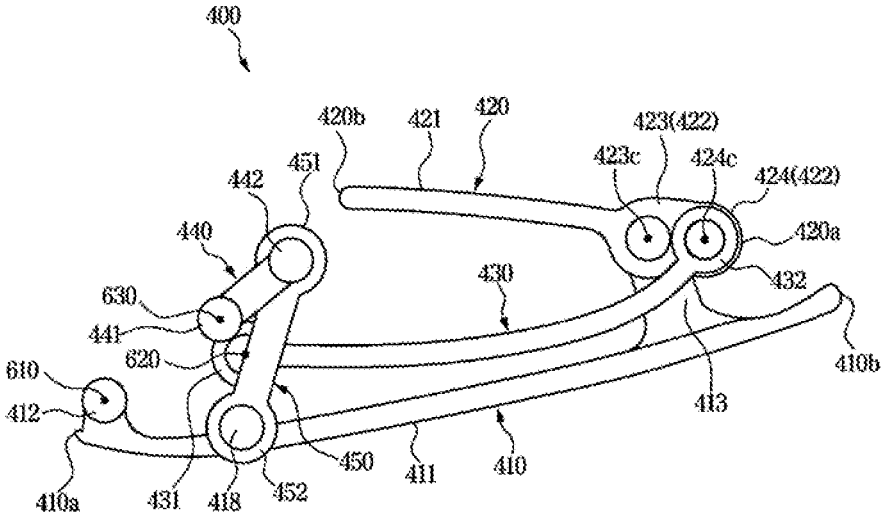
FIG. 28 is a side view illustrating the blade shown in FIG. 26.
Figure 29:
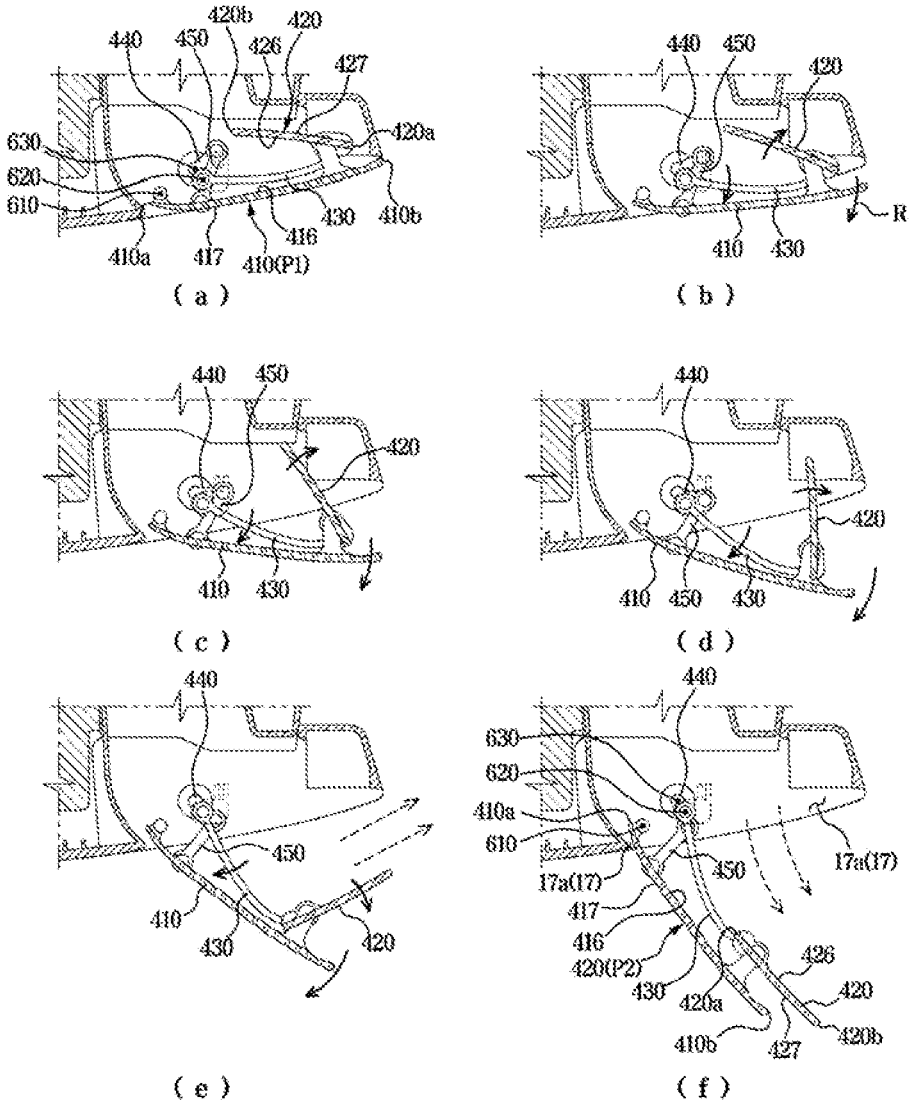
FIG. 29 is a schematic view illustrating an operation process of the blade in the air conditioner of FIG. 24.

FIG. 24 is a perspective view illustrating a ceiling type air conditioner according to still another embodiment of the present disclosure, FIG. 25 is a cross-sectional view taken along line IV-IV' in FIG. 24, FIG. 26 is a perspective view illustrating a blade of the air conditioner shown in FIG. 24, FIG. 27 is an enlarged view illustrating part 'F' shown in FIG. 26, FIG. 28 is a side view illustrating the blade shown in FIG. 26, and FIG. 29 is a schematic view illustrating an operation process of the blade in the air conditioner of FIG. 24.

Hereinafter, an air conditioner 4 according to still another embodiment of the present disclosure will be described. In the following description, parts performing substantially the same function will be assigned the same reference numeral, and details of parts that are identical or equivalent to those of the air conditioner 3 described above will be omitted.

Compared with the blade unit 300 of the air conditioner 3 described above, a blade unit 400 of the air conditioner 4 may further include a first driving link 440 and a second driving link 450. In addition, the first driving link 440 may be connected to a motor 150 to transmit a rotation force to a main blade 410. That is, the main blade 410 may not directly receive a rotation force from the motor 150. Except the construction, the air conditioner 4 is substantially the same as the air conditioner 3 described above, and details thereof may be omitted.

Referring to FIG. 25, the blade unit 400 may include the main blade 410, a sub-blade 420, and a guide link 430. In addition, the blade unit 400 may further include the first driving link 440 and the second driving link 450.

The main blade 410 may be rotatably provided to adjust the opening/closing range of an outlet 17. The main blade 410 may rotate with respect to a first rotation center 610. The main blade 410 may rotate in one direction R.

The main blade 410 may rotate within a predetermined angle range. For example, the main blade 410 may rotate between a first position P1 and a second position P2. When the main blade 410 is in the first position P1, the air conditioner 4 may be in an OFF state or a windless operation state (see drawing (a) of FIG. 29). In addition, when the main blade 410 is in the second position P2, the air conditioner 4 may be in a speed operation state (see drawing (f) of FIG. 29(*f*)). According to the position of the main blade 410, the air conditioner 4 may control the airflow at various angles. The operation and/or operation state of the air conditioner 4 is substantially the same as the operation and/or operation state of the air conditioner 3 described above, and details thereof will be omitted.

Referring to FIGS. 26 to 28, the main blade 410 may include a main blade body 411, a first coupling portion 412, a second coupling portion 413, and a third coupling portion 414.

The main blade body 411 may guide air discharged through the outlet 17. The main blade body 411 may have a substantially plate shape. For example, the main blade body 411 may include a rectangular shape having a pair of long sides 418 and a pair of short sides 419.

In case the main blade 410 is in the first position P1, a side of the main blade body 411 in which the long side 418 adjacent to the inlet 15 is arranged may be referred to as one side 410*a* of the main blade 410, and a side of the main blade body 411 in which the long side 418 distant from the inlet 15 is arranged may be referred to as the other side 410*b* of the main blade 420. That is, the one side 410*a* of the main blade 410 may be provided further rearward than the other side 410*b*.

In case the main blade 410 is in the first position P1, a surface of the main blade body 411 directed to the inside of the housing 20 may be referred to as a first surface 416 of the main blade 410, and a surface of the main blade body 411 directed the outside of the housing 20 may be referred to as a second surface 417 of the main blade 410.

The first coupling portion 412 of the main blade 410 may be provided to rotate with respect to the first rotation center 610. The first coupling portion 412 of the main blade 410 may be provided to be rotatably coupled to an inner surface 20*a* of the housing 20. The main blade 410 may be supplied with a rotation force by the first driving link 440 and the second driving link 450 and rotate with respect to the first rotation center 610.

The first coupling portion 412 may be provided to extend upward from the main blade body 411. The first coupling portion 412 may be provided to protrude from the main blade body 411 toward the inner surface 20*a* of the housing 20. For example, the first coupling portion 412 may be provided on the one side 410*a* of the main blade 410. The first coupling portion 412 may be arranged adjacent to the one side 410*a* of the main blade 410 than the second coupling portion 413 is. The second coupling portion 413 may be coupled to the sub-blade 420. The second coupling portion 413 has the substantially same configuration as that of the sub-blade coupling portion 313 of the air conditioner 3 described above, and details thereof may be omitted.

The second coupling portion 413 may extend upward from the main blade body 411. For example, the second coupling portion 413 may be provided on the other side 410*b* of the main blade 410. The second coupling portion 413 may be arranged adjacent to the other side 410*b* of the main blade body 411 than the first coupling portion 412 is.

The second coupling portion 413 may include a coupling body 413*a* positioned in a cutout portion 425 of the sub-blade 420 and a protrusion 413*b* which extends from the coupling body 413*a* so as to be coupled to a first joint portion 423 of the sub-blade 420.

The third coupling portion 418 may be coupled to the second driving link 450. The third coupling portion 418 may be rotatably coupled to a second end portion 452 of the second driving link 450. The third coupling portion 418 may be provided to receive a rotation force of the motor 150 from the first driving link 440 and the second driving link 450. Accordingly, the main blade 410 may be provided to be rotatable with respect to the first rotation center 610. For example, the third coupling portion 418 may be arranged between the first coupling portion 412 and the second coupling portion 413.

The sub-blade 420 may be provided to operate in association with the rotation of the main blade 410. For example, the sub-blade 420 may be rotatably coupled to the main blade 410. The sub-blade 420 may be provided to rotate in the same direction as the main blade 410. As the sub-blade 420 rotates, the discharge direction of the air discharged to the outlet 17 may be adjusted. Because the rotation operation of the sub-blade 420 is substantially the same as the rotation operation of the sub-blade 320 described above, details thereof will be omitted.

Referring to FIGS. 26 to 28, the sub-blade 420 may include a sub-blade body 421.

The sub-blade body 421 may guide the air discharged through the outlet 17. The sub-blade body 421 may have a substantially plate shape. For example, the sub-blade body 421 may include a rectangular shape having a pair of long sides 428 and a pair of short sides 429.

In case the main blade 410 is in the first position P1, a side of the sub-blade body 421 in which the long side 428 distant from the inlet 15 is arranged may be referred to as one side 420*a* of the sub-blade 420, and a side of the sub-blade body 421 in which the long side 428 adjacent to the inlet 15 is arranged may be referred to as the other side 420*b* of the sub-blade 420. For example, when the main blade 410 is in the first position P1, the one side 420*a* of the sub-blade 420 may be provided further forward than the other side 420*b*. Conversely, when the main blade 410 is in the second position P2, the one side 420*a* of the sub-blade 420 may be provided further rearward than the other side 420*b*.

When the main blade 410 is in the first position P1, a surface of the sub-blade body 421 directed toward the man blade 410 may be referred to as a first surface 426 of the sub-blade 420, and a surface of the sub-blade body 421 opposite to the first surface 426 may be referred to as a second surface 427 of the sub-blade 420.

The sub-blade 420 may be provided to be coupled to the main blade 410 and the guide link 430. The sub-blade 420 may include a connection portion 422 coupled to the main blade 410 and the guide link 430.

The connection portion 422 may include a first joint portion 423 rotatably coupled to the main blade 410. For example, the first joint portion 423 may include a coupling hole 4230 coupled to the protrusion 413*b* of the sub-blade coupling portion 413. The connection portion 422 may include a second joint portion 424 rotatably coupled to the guide link 430. For example, the second joint portion 424 may include a coupling protrusion 4240 coupled to a second hole 4320 of a second end portion 432 of the guide link 430. However, the coupling method of the connection portion 422 is not limited to the above-described example, and the sub-blade 420 may be rotatably coupled to the main blade 410 and the guide link 430 in various ways.

The connection portion 422 may further include the cutout portion 425 that is a predetermined portion cut from the one side 420*a* toward the other side 420*b* of the sub-blade 420. The coupling body 413*a* of the main blade 410 may be located in the cutout 425.

The connection portion 422 may be provided on the one side 420*a* of the sub-blade 420.

The main blade 410 may further include a plurality of first discharge holes (not shown) passing through the main blade body 411. The sub-blade 420 may further include a plurality of second discharge holes (not shown) passing through the sub-blade body 412. The blade unit 400 discharges air through the plurality of first discharge holes and the plurality of second discharge holes, thereby implementing a windless airflow.

The guide link 430 may be provided to guide the movement of the sub-blade 420. The guide link 430 may include a link body 430*a*, a first end portion 431 provided at one end of the link body 430*a*, and a second end portion 432 provided at the other end of the link body 430*a*.

The first end portion 431 of the guide link 430 may be provided to form a second rotation center 620. The first end portion 431 may be rotatably coupled to the inner surface 20*a* of the housing 20. The second end portion 432 of the guide link 430 may be provided to be coupled to the second joint portion 424 of the sub-blade 420.

The first driving link 440 may include a first body 440*a*, a first end portion 441 provided at one end of the first body 440*a*, and a second end portion 442 provided at the other end of the first body 440*a*.

The first end portion 441 of the first driving link 440 may be connected to the motor 150 to receive a rotation force. The first end portion 441 may form a motor rotation center 630. In addition, the second end portion 442 of the first driving link 440 may be connected to the first end portion 451 of the second driving link 450. Accordingly, the first driving link 440 may transmit the rotation force of the motor 150 to the second driving link 450.

The second driving link 450 may include a second body 450*a*, a first end portion 451 provided at one end of the second body 450*a*, and a second end portion 452 provided at the other end of the second body 450*a*.

The first end portion 451 of the second driving link 450 may be connected to the second end portion 442 of the first driving link 440. The second end portion 452 of the second driving link 450 may be connected to the main blade 410. The second end portion 452 may be connected to the third coupling portion 418 of the main blade 410. The second driving link 450 may transmit the rotation force received from the first driving link 440 to the main blade 410.

According to the present disclosure, the main blade 410 may receive a rotation force from the motor 150 through the first and second driving links 440 and 450 rather than directly receiving the rotation force from the motor 150. That is, the main blade 410 may not be directly driven by the motor 150, but be driven by the first and second driving links 440 and 450 connected to the motor 150.

Accordingly, unlike the above-described embodiment (the blade unit 300), the first rotation center 610 and the motor rotation center 630 may be provided different from each other. Accordingly, the area occupied by the main blade 410 on the outlet 17 for coupling with the motor 150 may be significantly reduced. In addition, because the main blade 410 is not driven directly by the motor 150, but is driven by the first and second driving links 440 and 450, the rotation may be more freely performed compared to the above-described embodiment.

For example, a region provided between the first surface 416 of the main blade 410 and the housing 20 on the outlet 17 due to rotation of the main blade 410 may be defined as a front outlet 17*a*, and a region provided between the second surface 417 of the main blade 410 and the housing 20 on the outlet 17 may be defined as a rear outlet 17*b*. In this case, the main flow of air discharged through the outlet 17 may be formed in the front outlet 17*a*. Because the main blade 410 is not directly connected to the motor 150, rotation may be more freely performable, and the area of the front outlet 17*a* may be maximally secured. Accordingly, the amount of air discharged through the front outlet 17*a* may be increased, and the efficiency of the air conditioner 4 may be improved.

Hereinafter, an operation process of the blade unit 400 will be described with reference to FIG. 29.

Referring to FIG. 29, the first driving link 440 may receive a rotation force from the motor 150 and rotate in one direction R. The second driving link 450 connected to the first driving link 440 may transmit a rotation force to the main blade 410. For example, the second end portion 452 of the second driving link 450 may be provided to push the third coupling portion 418 of the main blade 410 with a predetermined force. The main blade 410 may receive a rotation force from the second driving link 450 and rotate in the one direction R. According to the rotation of the main blade 410, the sub-blade 420 and the guide link 430 may rotate in association with the rotation of the main blade 410.

Subsequent to the above, operations of the main blade 410, the sub-blade 420, and the guide link 430 may be substantially the same as the operations of the main blade 310, the sub-blade 320, and the guide link 330 described above.

That is, the guide link 430 guides the movement of the sub-blade 420, the second joint portion 424 of the sub-blade 420 rotates while moving downward, and the first joint portion 423 rotates while moving upward. As a result, rotation of the connection portion 422 provided on the one side 420*a* of the sub-blade 420 may allow the other side

420*b* of the sub-blade 420 to be unfolded toward the outside of the housing 20. As the main blade 410 and the sub-blade 420 rotate, the angle between the main blade 410 and the sub-blade 420 may increase. Thereby, the blade unit 400 may guide the air discharged through the outlet 17 to reach a longer distance.

On the other hand, similar to the above-described blade unit 300, the blade unit 400 may also be driven in the first mode, the second mode, and the third mode. Accordingly, the blade unit 400 may guide the airflow in various ways.

The scope of the disclosure is not limited to the aforementioned embodiments. It will be understood by those skilled in the art that various changes in form and details may be made therein without departing from the spirit and scope of the disclosure as defined by the appended claims and their equivalents.

What is claimed is:

1. A ceiling type air conditioner comprising:

a housing having an inlet and an outlet;

a heat exchanger provided inside the housing to exchange heat with air suctioned through the inlet;

a fan configured to move the air, which is heat exchanged with the heat exchanger, to be discharged through the outlet; and a blade assembly configured to guide the air to the outlet, the blade assembly including:

a main blade rotatable with respect to a first rotation center to open and close the outlet, the main blade including a sub-blade coupling portion extending from the main blade at a side of the main blade opposite to the first rotation center, a sub-blade rotatably coupled to the sub-blade coupling portion at a first joint portion to be rotatable about the first joint portion so that a first side of the sub-blade moves closer to the first rotation center, and a second side of the sub-blade that is opposite the first side moves further from the first rotation center, during a rotation of the main blade to open the outlet, thereby increasing a discharge distance of the air flowing out of the outlet, and a guide link configured to rotate with respect to a second rotation center in association with the rotation of the main blade, and coupled to the first side of the sub-blade at a second joint portion that is rotatable about the first joint portion to guide a movement of the sub-blade.

2. The ceiling type air conditioner of claim 1, wherein the sub-blade includes:

the first joint portion rotatably coupled to the sub-blade coupling portion; and the second joint portion rotatably coupled to the guide link.

3. The ceiling type air conditioner of claim 2, wherein the guide link includes:

a first end portion provided to form the second rotation center; and a second end portion rotatably coupled to the second joint portion of the sub-blade.

4. The ceiling type air conditioner of claim 1, wherein the sub-blade is provided to adjust a discharge direction of the air discharged through the outlet.

5. The ceiling type air conditioner of claim 2, wherein the main blade is rotatable between a first position and a second position, and when the main blade is in the first position, the first joint portion of the sub-blade is located above the second joint portion, and when the main blade is in the second position, the first joint portion of the sub-blade is located below the second joint portion.

6. The ceiling type air conditioner of claim 5, wherein during a heating operation, the main blade is located in the second position.

7. The ceiling type air conditioner of claim 5, wherein the sub-blade further includes a first surface that faces the main blade when the main blade is in the first position, and a second surface opposite to the first surface.

8. The ceiling type air conditioner of claim 7, wherein when the main blade is in the second position, the first surface of the sub-blade is provided to guide the air discharged to the outlet, and a portion of the second surface of the sub-blade is provided to face the main blade.

9. The ceiling type air conditioner of claim 1, wherein as the main blade and the sub-blade rotate, an angle between the main blade and the sub-blade increases.

10. The ceiling type air conditioner of claim 2, wherein a distance between the second rotation center and the second joint portion is shorter than a distance between the first rotation center and the first joint portion.

11. The ceiling type air conditioner of claim 1, wherein the blade assembly further includes a motor configured to provide a rotation force, and the main blade is coupled to a rotating shaft of the motor.

12. The ceiling type air conditioner of claim 1, wherein the blade assembly includes:

a motor configured to provide a rotation force;

a first driving link provided coupled to a rotating shaft of the motor; and a second driving link having one end portion coupled to the first driving link and another end portion coupled to the main blade, the second driving link configured to guide a movement of the main blade such that the main blade rotates with respect to the first rotation center.

13. The ceiling type air conditioner of claim 1, wherein the main blade includes a main blade body and a plurality of first discharge holes formed to pass through the main blade body;

the sub-blade includes a sub-blade body and a plurality of second discharge holes passing through the sub-blade body; and the blade assembly is provided to move air through the plurality of first discharge holes and the plurality of second discharge holes.

14. The ceiling type air conditioner of claim 1, wherein the sub-blade rotates in a same direction as the main blade.

15. The ceiling type air conditioner of claim 1, wherein the blade assembly is operable in a first mode for discharging air through a plurality of first discharge holes formed in the main blade and a plurality of second discharge holes formed in the sub-blade, a second mode for allowing air discharged to the outlet to be guided in a downward direction, and a third mode for allowing air discharged to the outlet to be guided in a horizontal direction.

* * * * *